US012281558B2

(12) United States Patent
Thomas et al.

(10) Patent No.: US 12,281,558 B2
(45) **Date of Patent: *Apr. 22, 2025**

(54) METHODS OF STIMULATING A HYDROCARBON WELL

(71) Applicant: ExxonMobil Technology and Engineering Company, Spring, TX (US)

(72) Inventors: James B. Thomas, Aledo, TX (US); Owen J. Hehmeyer, Houston, TX (US); Nancy H. Choi, Ft. Worth, TX (US); Erik N. English, Ft. Worth, TX (US); Eric R. Grueschow, Naperville, IL (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/501,155

(22) Filed: Nov. 3, 2023

(65) Prior Publication Data

US 2024/0060409 A1 Feb. 22, 2024

Related U.S. Application Data

(63) Continuation of application No. 17/934,281, filed on Sep. 22, 2022, now Pat. No. 11,852,002, which is a continuation of application No. 17/227,696, filed on Apr. 12, 2021, now Pat. No. 11,512,572.

(60) Provisional application No. 63/030,993, filed on May 28, 2020.

(51) Int. Cl.
*E21B 43/26* (2006.01)
*E21B 43/267* (2006.01)

(52) U.S. Cl.
CPC ..... *E21B 43/261* (2013.01); *E21B 43/267* (2013.01)

(58) Field of Classification Search
None
See application file for complete search history.

(56) References Cited

U.S. PATENT DOCUMENTS 11,512,572 B2 * 11/2022 Thomas ..... E21B 43/261
11,852,002 B2 * 12/2023 Thomas ..... E21B 33/12
2001/0050172 A1 * 12/2001 Tolman ..... E21B 43/27 166/305.1

(Continued)

*Primary Examiner* — Andrew Sue-Ako
(74) *Attorney, Agent, or Firm* — ExxonMobil Technology and Engineering Company—Law Department

(57) ABSTRACT

Methods of stimulating a hydrocarbon well are disclosed herein. The hydrocarbon well includes a wellbore that extends within a subterranean formation and a tubular that extends within the wellbore and defines a tubular conduit. The methods include retaining a sealing structure within the tubular conduit and, during the retaining, stimulating a zone of the subterranean formation. Subsequent to the stimulating, the methods include fluidly isolating the zone of the subterranean formation from the uphole region by at least partially sealing the plurality of perforations. Subsequent to the fluidly isolating, the methods include moving the sealing structure in a downhole direction within the tubular conduit. The methods also include repeating the retaining, the stimulating, the fluidly isolating, and the moving a plurality of times to stimulate a plurality of corresponding zones of the subterranean formation.

19 Claims, 24 Drawing Sheets

(56) References Cited

U.S. PATENT DOCUMENTS

2005/0241835 A1* 11/2005 Burris, II ..... E21B 23/10
166/313

* cited by examiner

METHODS OF STIMULATING A HYDROCARBON WELL

CROSS-REFERENCE TO RELATED APPLICATIONS

This application is a continuation of U.S. patent application Ser. No. 17/934,281, entitled "Methods of Stimulating a Hydrocarbon Well," filed Sep. 22, 2022, which is hereby incorporated by reference in its entirety, which is a continuation of continuation of U.S. patent application Ser. No. 17/227,696, entitled "Methods of Stimulating a Hydrocarbon Well," filed Apr. 12, 2021, which is hereby incorporated by reference in its entirety, which claims the benefit of U.S. Provisional Application 63/030,993, entitled "Methods of Stimulating a Hydrocarbon Well," filed May 28, 2020, the disclosure of which is hereby incorporated by reference in its entirety.

FIELD OF THE INVENTION

The present disclosure relates generally to methods of stimulating a hydrocarbon well.

BACKGROUND OF THE INVENTION

A variety of stimulation methodologies, including hydraulic fracturing are known. In conventional hydraulic fracturing operations, a plug is placed within a pipe and downhole from a zone of the subterranean formation that is to be stimulated. Then, the pipe is perforated above the plug, and a stimulant fluid stream, which may include a proppant, flows through the perforations and into the subterranean formation. The pressure generated by flow of this stimulant fluid stream fractures the zone of the subterranean formation, thereby increasing a fluid permeability thereof. Subsequently, another plug is positioned within the pipe uphole from the perforations, and the process is repeated a plurality of times to stimulate a plurality of corresponding zones of the subterranean formation.

While effective in certain circumstances, conventional hydraulic fracturing operations have several limitations. As an example, conventional hydraulic fracturing operations cannot be utilized to stimulate a previously stimulated hydrocarbon well and/or a hydrocarbon well that includes pre-perforated pipe, as the large number of perforations present within the pipe generally precludes generation of sufficient pressure to (re)fracture the subsurface region. As another example, conventional hydraulic fracturing operations abandon a large number of plugs within the pipe. These plugs are spaced apart along the length of the pipe and must be removed prior to production from the hydrocarbon well. This removal is time-consuming and expensive. Thus, there exists a need for improved methods of stimulating a hydrocarbon well, and more particularly, to such methods that facilitate stimulation of previously stimulated hydrocarbon wells, that facilitate stimulation of hydrocarbon wells that include pre-perforated pipe, and/or that decrease, or eliminate, the need to remove a plurality of installed plugs prior to production from the hydrocarbon well.

SUMMARY OF THE INVENTION

Methods of stimulating a hydrocarbon well are disclosed herein. The hydrocarbon well includes a wellbore that extends within a subterranean formation and a tubular that extends within the wellbore and defines a tubular conduit.

The methods include retaining a sealing structure within the tubular conduit. The retaining includes retaining the sealing structure to at least partially fluidly isolate an uphole region of the tubular conduit, which is uphole from the sealing structure, from a downhole region of the tubular conduit, which is downhole from the sealing structure. During the retaining, the methods also include stimulating a zone of the subterranean formation. The stimulating includes stimulating the zone of the subterranean formation by providing a stimulant fluid stream to the uphole region and flowing the stimulant fluid stream into the zone of the subterranean formation via a plurality of perforations defined within a portion of the tubular that defines the uphole region. Subsequent to the stimulating, the methods include fluidly isolating the zone of the subterranean formation from the uphole region by at least partially sealing the plurality of perforations. Subsequent to the fluidly isolating, the methods include moving the sealing structure in a downhole direction within the tubular conduit. The methods also include repeating the retaining, the stimulating, the fluidly isolating, and the moving a plurality of times to stimulate a plurality of corresponding zones of the subterranean formation.

DETAILED DESCRIPTION OF THE INVENTION

Figure 1:
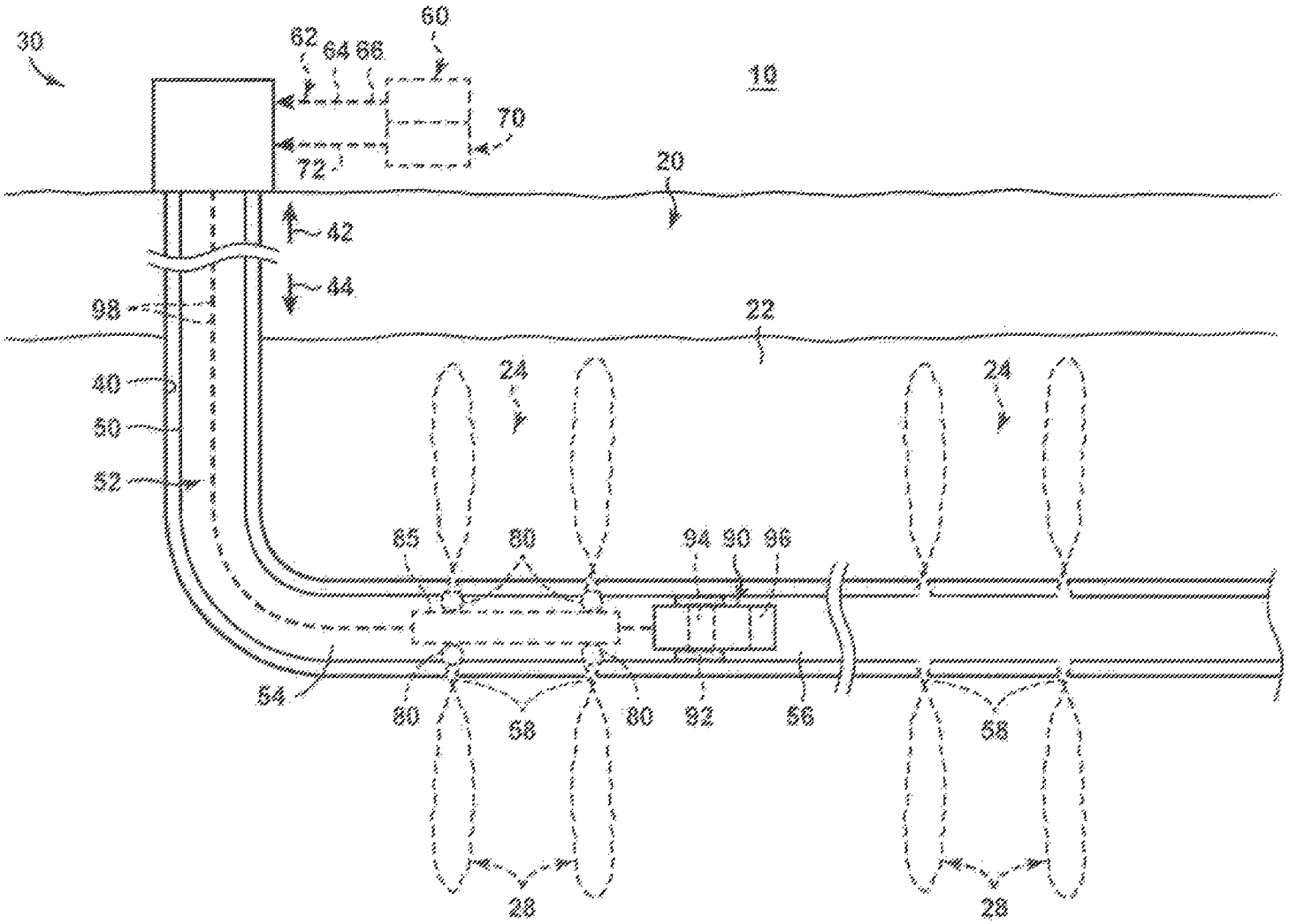
FIG. 1 is a schematic illustration of examples of a hydrocarbon well that may be utilized to perform methods, according to the present disclosure.

FIGS. 1-24 provide examples of methods 100, of hydrocarbon wells 30 that may be utilized to perform methods 100, and/or of steps in process flows according to methods 100. Elements that serve a similar, or at least substantially similar, purpose are labeled with like numbers in each of FIGS. 1-24, and these elements may not be discussed in detail herein with reference to each of FIGS. 1-24. Similarly, all elements may not be labeled in each of FIGS. 1-24, but reference numerals associated therewith may be utilized herein for consistency. Elements, components, and/or features that are discussed herein with reference to one or more of FIGS. 1-24 may be included in and/or utilized with any of FIGS. 1-24 without departing from the scope of the present disclosure.

In general, elements that are likely to be included in a particular embodiment are illustrated in solid lines, while elements that are optional are illustrated in dashed lines. However, elements that are shown in solid lines may not be essential to all embodiments and, in some embodiments, may be omitted without departing from the scope of the present disclosure.

FIG. 1 is a schematic illustration of examples of a hydrocarbon well 30 that may be utilized to perform methods 100, according to the present disclosure. As illustrated in FIG. 1, hydrocarbon well 30 includes a wellbore 40 that extends within a subsurface region 20. Wellbore also may be referred to herein as extending within a subterranean formation 22 of the subsurface region and/or as extending between a surface region 10 and the subterranean formation. A tubular 50 extends within wellbore 40 and defines a tubular conduit 52.

During stimulation of hydrocarbon well 30, such as via methods 100, a sealing structure 90 may be positioned and/or retained within tubular conduit 52. As a result, the sealing structure may at least partially, or in some examples completely, fluidly isolate an uphole region 54 of the tubular conduit, which is uphole from the sealing structure, from a downhole region 56 of the tubular conduit, which is downhole from the sealing structure. Uphole region 54 additionally or alternatively may be referred to herein as being in an uphole direction 42 from the sealing structure, and downhole region 56 additionally or alternatively may be referred to herein as being in a downhole direction 44 from the sealing structure.

In some examples, the hydrocarbon well may be a previously unstimulated hydrocarbon well and/or tubular 50 may be an unperforated tubular. In such examples, a perforation device 85 may be utilized to form and/or define one or more perforations 58 within a region of the tubular that defines uphole region 54 and/or that is uphole from the sealing structure. In some examples, such as when the tubular is a pre-perforated tubular and/or when the hydrocarbon well is a previously stimulated hydrocarbon well, perforations 58 already may be present within tubular 50.

While sealing structure 90 is retained within tubular conduit 52, a stimulant fluid stream 62 may be provided to uphole region 54 of the tubular conduit. The stimulant fluid stream may flow into a zone 24 of the subterranean formation via perforations 58 and may stimulate the zone of the subterranean formation. This stimulation may form and/or increase a size of fractures 28 that extend within the subterranean formation, thereby increasing a fluid permeability of the subterranean formation and/or decreasing a resistance to fluid flow from the subterranean formation and into tubular conduit 52.

After stimulation of the zone of the subterranean formation, diversion structures 80 may be utilized to at least partially, or event completely, fluidly isolate the zone of the subterranean formation from uphole region 54 of the tubular conduit. Then, sealing structure 90 may be moved in downhole direction 44, and the process may be repeated to stimulate another zone 24 of the subterranean formation.

Sealing structure 90 may include any suitable structure that may be adapted, configured, designed, and/or constructed to at least partially, or in some examples completely, fluidly isolate uphole region 54 from downhole region 56. Sealing structure may further include any suitable structure that may be configured to be retained within the tubular conduit and/or that may be configured to be selectively moved in downhole direction 44 within the tubular conduit. Examples of such sealing structures 90 include a plug, a packer, and a cleaning pig.

In some examples, sealing structure 90 may be operatively attached to a tether 98, which may extend between the sealing structure and surface region 10. In some such examples, tether 98 may be utilized to position and/or to retain the sealing structure within the tubular conduit and/or to facilitate selected motion of the sealing structure within the tubular conduit. As an example, a tension applied to tether 98 may retain the sealing structure within a given region of the tubular conduit, while slack permitted in tether 98 may facilitate motion of the sealing structure in the downhole direction. Examples of tether 98 include a wireline, a slickline, coiled tubing, and/or jointed pipe. In some examples, sealing structure 90 may be an autonomous, or an untethered, sealing structure configured for at least partially autonomous motion within the tubular conduit In some examples, and as illustrated in dashed lines in FIG. 1, sealing structure 90 may include a resilient sealing body 92. Resilient sealing body 92, when present, may be configured to selectively retain the sealing structure within the tubular conduit and/or to at least partially fluidly isolate the uphole region of the tubular conduit from the downhole region of the tubular conduit. For example, resilient sealing body 92 may be configured to selectively expand, to selectively contract, and/or to selectively deform to provide selective retention of the sealing structure. Examples of resilient sealing body 92 include a resilient material, a resilient ring, and/or a polymeric ring, which may extend at least partially, or even completely, about an outer perimeter and/or a circumference of the sealing structure.

In some examples, and as illustrated in dashed lines in FIG. 1, sealing structure 90 may include an actuation mechanism 94. Actuation mechanism 94, when present, may be configured to selectively deform resilient sealing body 92, such as to permit the resilient sealing body to selectively retain the sealing structure within the tubular conduit and/or to at least partially fluidly isolate the uphole region of the tubular conduit from the downhole region of the tubular conduit. An example of actuation mechanism 94 includes a compression ring configured to compress the resilient sealing body.

In some examples, and as illustrated in dashed lines in FIG. 1, sealing structure 90 may include a tractor 96. Tractor 96, when present, may be configured to selectively provide a motive force to operatively translate sealing structure 90 within the tubular conduit, such as in the downhole direction. Examples of tractor 96 include any suitable wheel and/or gripping assembly configured to engage an inner surface of tubular 50. An additional example of tractor 96 includes a motor configured to operatively rotate the wheel.

As illustrated in dashed lines in FIG. 1, hydrocarbon well 30 may include a stimulant fluid supply system 60. Stimulant fluid supply system 60, when present, may be configured to provide stimulant fluid stream 62 to uphole region 54. In some examples, stimulant fluid stream 62 may include a stimulant liquid 64. In some examples, stimulant fluid stream 62 may include a proppant 66.

As illustrated in dashed lines in FIG. 1, hydrocarbon well 30 may include a motive fluid supply system 70. Motive fluid supply system 70, when present, may be configured to provide a motive fluid stream 72 to uphole region 54, such as to provide a motive force for flow and/or motion of sealing structure 90 in downhole direction 44. Motive fluid supply system 70 and/or motive fluid stream 72 may be separate and/or distinct from stimulant fluid supply system 60 and/or from stimulant fluid stream 62, respectively. Alternatively, motive fluid supply system 70 may be defined by stimulant fluid supply system 60, and/or motive fluid stream 72 may be defined by stimulant fluid stream 62. Stated another way, stimulant fluid supply system 60 may provide stimulant fluid stream 62 to uphole region 54 both to stimulate the subterranean formation and to provide the motive force for flow and/or motion of the sealing structure in downhole direction 44. Examples of the motive fluid supply system and/or of the stimulant fluid supply system include any suitable pump, fluid storage tank, proppant storage tank, slurry storage tank, valve, and/or fluid conduit that may be utilized to supply, or to selectively supply, the stimulant fluid stream and/or the motive fluid stream to the uphole region of the tubular conduit.

Diversion structures 80 may include any suitable structure that may be adapted, configured, designed, and/or constructed to at least partially, or even completely, fluidly isolate zone 24 of the subterranean formation from tubular conduit 52, such as by sealing perforations 58. Examples of diversion structures 80 include a mechanical diversion structure, a fibrous diversion structure, a ball sealer, a solid-particle diverting agent, a resilient diversion structure, a flexible diversion structure, and/or a plurality of knotted ropes. When the diversion structure includes the plurality of knotted ropes, the plurality of knotted ropes may include one or more frayed ends.

Perforation device 85, when present, may include any suitable structure that may be adapted, configured, designed, and/or constructed to form and/or define one or more perforations 58 within tubular 50. An example of perforation device 85 includes a shaped charge perforation device. In some examples, perforation device 85 may be operatively attached to a corresponding tether 98 and/or may be positioned within tubular conduit 52 with, via, and/or utilizing the corresponding tether. In some such examples, the corresponding tether also may be operatively attached to sealing structure 90. In some such examples, the corresponding tether may be operatively attached to perforation device 85 but not to sealing structure 90. In some such examples, another tether 98 may be operatively attached to sealing structure 90.

Figure 2:
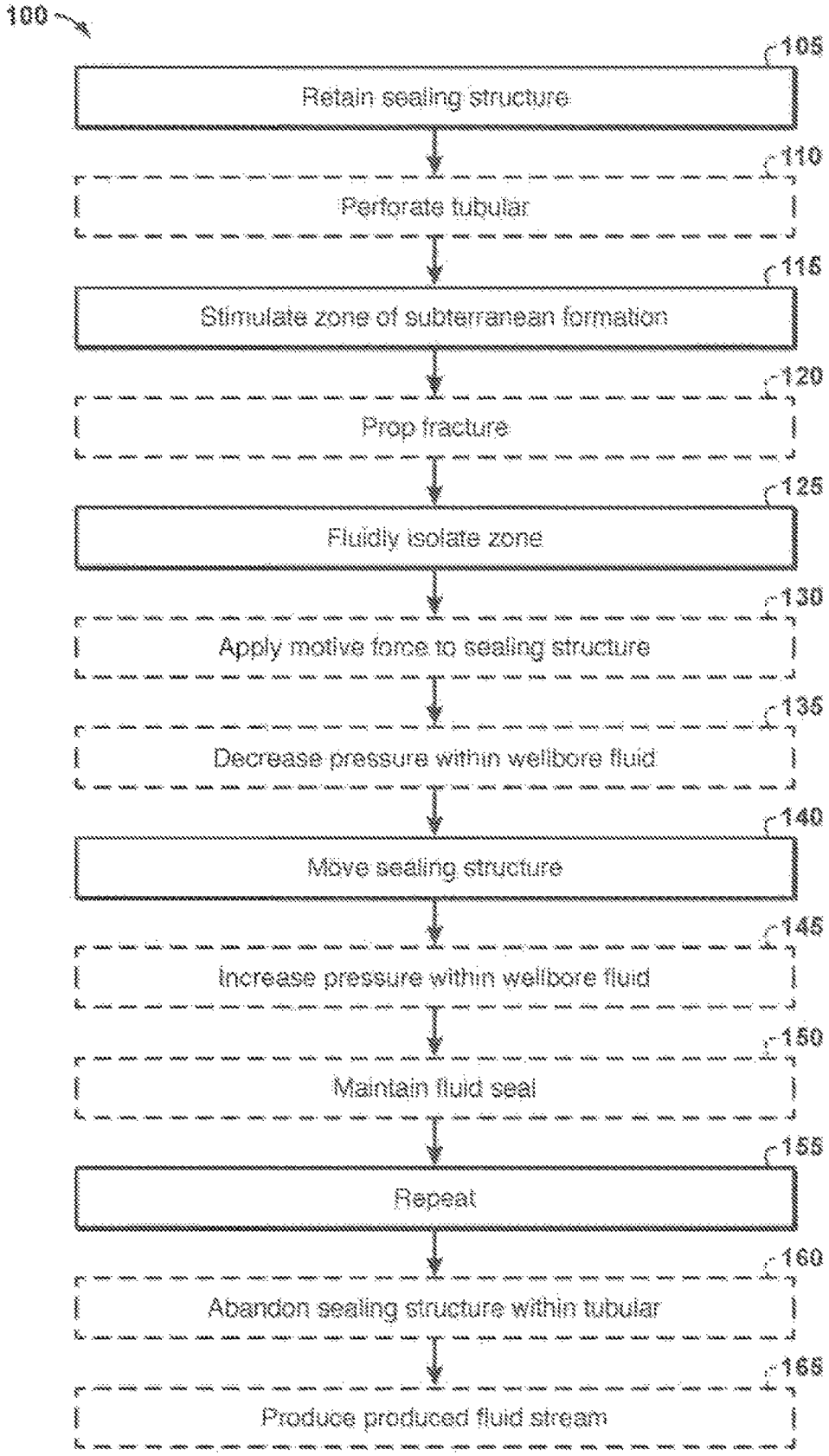
FIG. 2 is a flowchart depicting examples of methods of stimulating a hydrocarbon well, according to the present disclosure.

FIG. 2 is a flowchart depicting examples of methods 100 of stimulating a hydrocarbon well, according to the present disclosure. The hydrocarbon well includes a wellbore that extends within a subterranean formation, and a tubular that extends within the wellbore and defines a tubular conduit.

Figure 3:
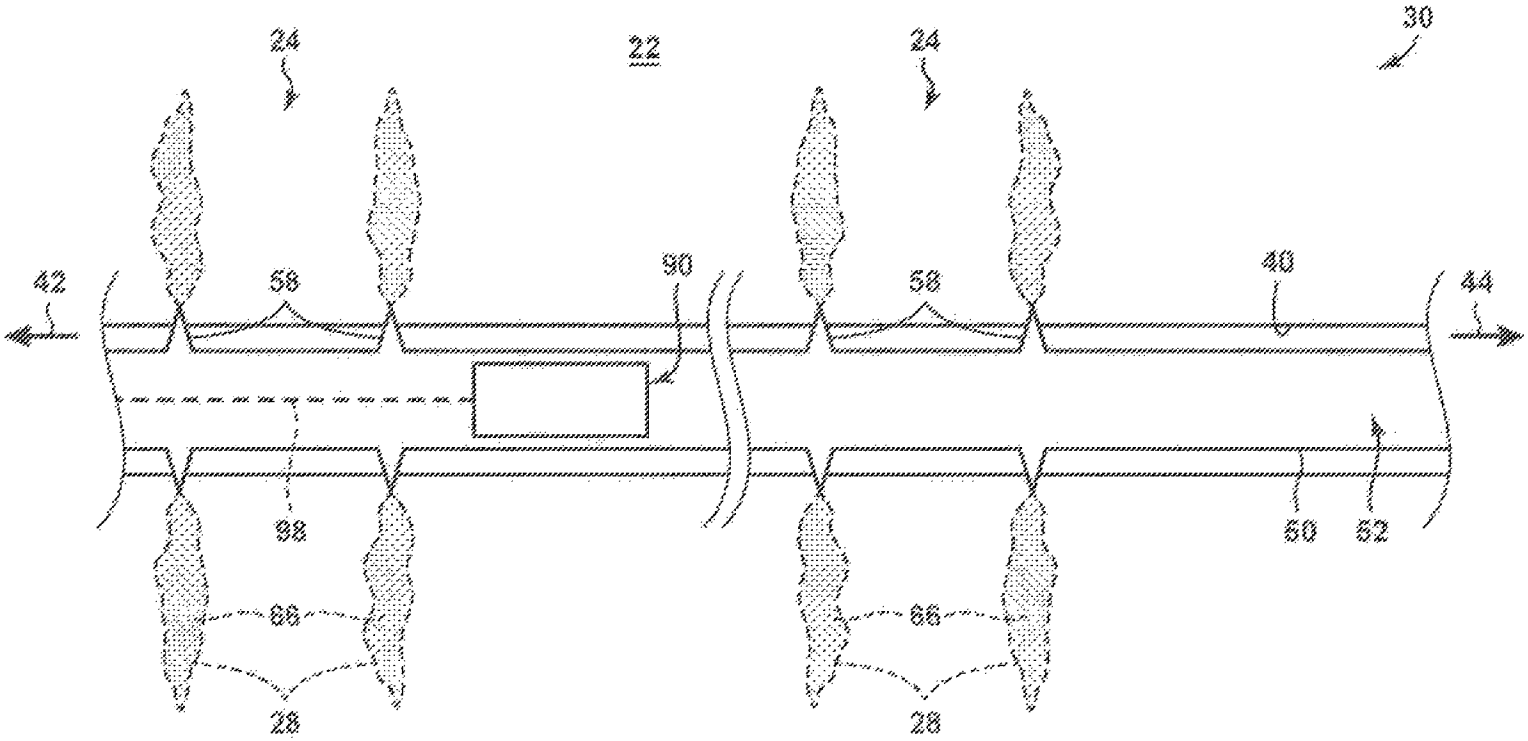
FIG. 3 is a schematic illustration of examples of a portion of a first process flow according to the methods of FIG. 2.

FIGS. 3-12 are schematic illustrations of examples of portions of a first process flow according to the methods of FIG. 2. As illustrated in FIG. 3, and prior to performing methods 100, a hydrocarbon well 30 may include a plurality of perforations 58 within a tubular 50. In some such examples, a tubular 50 may include and/or be a pre-perforated tubular 50 that includes perforations 58 prior to being positioned within wellbore 40. In some such examples, hydrocarbon well 30 may include and/or be a previously stimulated hydrocarbon well 30 that includes previously formed fractures 28, extending within subterranean formation 22, as illustrated in dashed lines in FIG. 3.

Figure 13:
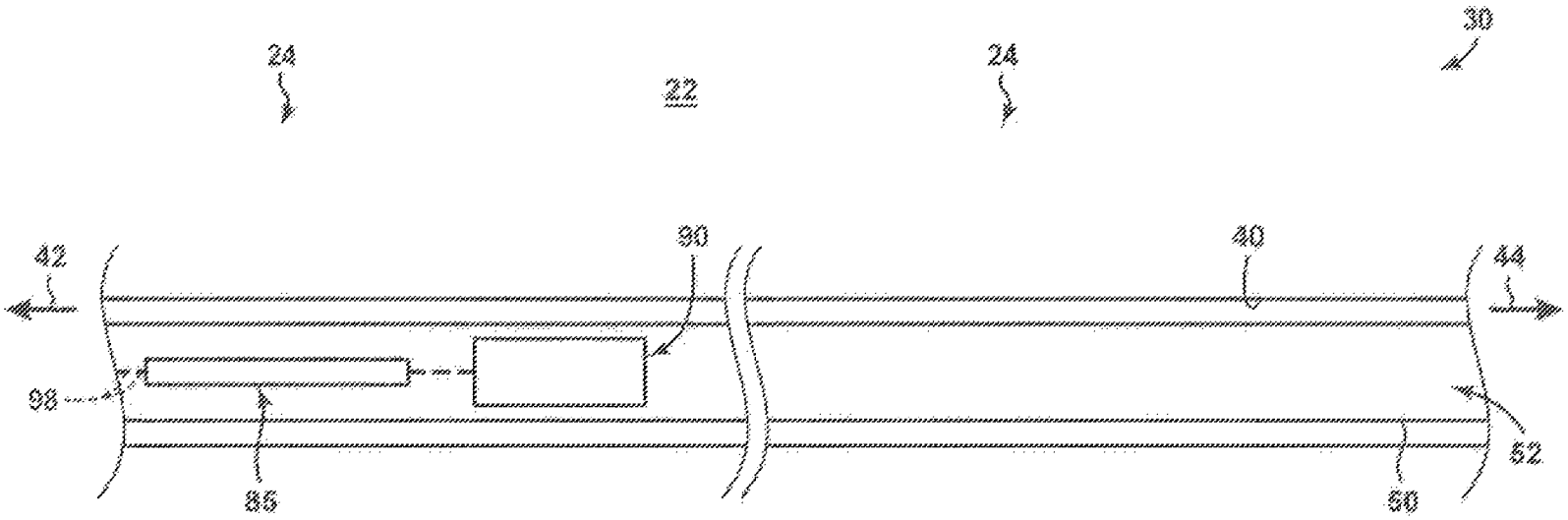
FIG. 13 is a schematic illustration of examples of a portion of a second process flow according to the methods of FIG. 2.

FIGS. 13-24 are schematic illustrations of examples of portions of a second process flow according to the methods of FIG. 2. As illustrated in FIG. 13, and prior to performing methods 100, a hydrocarbon well 30 may not include perforations 58 within a tubular 50.

Methods 100 include retaining a sealing structure at 105, and methods 100 may include perforating the tubular at 110. Methods 100 also include stimulating a zone of the subterranean formation at 115 and may include propping a fracture at 120. Methods 100 further include fluidly isolating the zone of the subterranean formation at 125 and may include applying a motive force to the sealing structure at 130 and/or decreasing a pressure within a wellbore fluid at 135. Methods 100 also include moving the sealing structure at 140 and may include increasing the pressure within the wellbore fluid at 145, and/or maintaining a fluid seal at 150. Methods 100 further include repeating at least a portion of the methods at 155 and may include abandoning the sealing structure within the tubular conduit at 160 and/or producing a produced fluid stream at 165.

Retaining the sealing structure at 105 may include retaining the sealing structure within the tubular conduit to at least partially, or even completely, fluidly isolate an uphole region of the tubular conduit, such as uphole region 54 of FIG. 1, from a downhole region of the tubular conduit, such as downhole region 56 of FIG. 1. The retaining at 105 may be accomplished in any suitable manner. As an example, the retaining at 105 may include operatively engaging the tubular with the sealing structure. As another example, the retaining at 105 may include utilizing a tether, such as tether 98 of FIG. 1, to retain the sealing structure within the tubular conduit. Examples of the tether are disclosed herein with reference to tether 98 of FIG. 1.

The retaining at 105 additionally or alternatively may include establishing an at least partial fluid seal between the sealing structure and the tubular. As an example, the at least partial fluid seal may be sufficient to direct a threshold fraction of a stimulant fluid stream through a plurality of perforations during the stimulating at 115. Examples of the threshold fraction include at least 50%, at least 60%, at least 70%, at least 80%, at least 90%, at least 95%, at least 99%, or 100% of the stimulant fluid stream. As another example, the retaining at 105 may include at least substantially completely blocking flow of the stimulant fluid stream from the uphole region to the downhole region via the tubular conduit.

Figure 4:
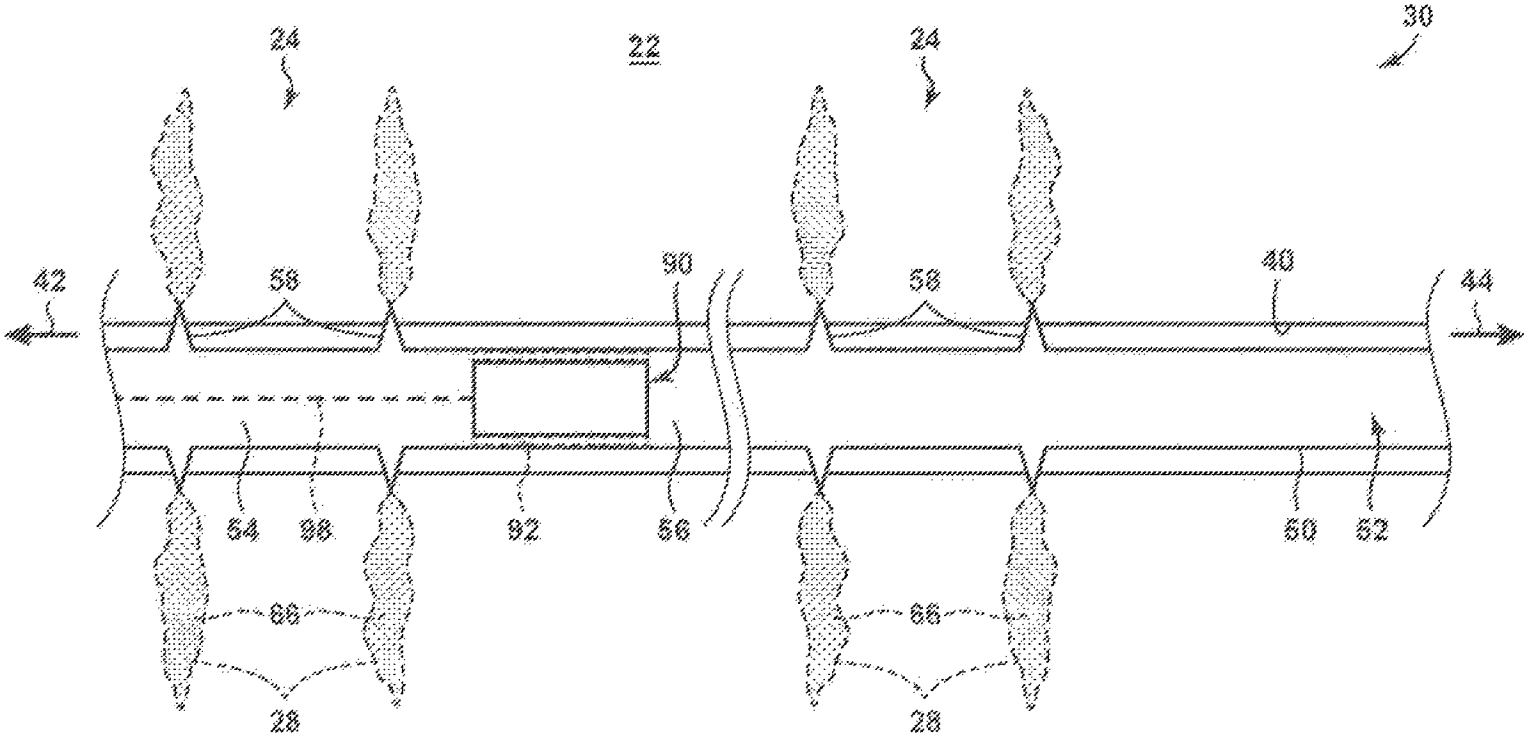
FIG. 4 is a schematic illustration of examples of another portion of the first process flow.
Figure 14:
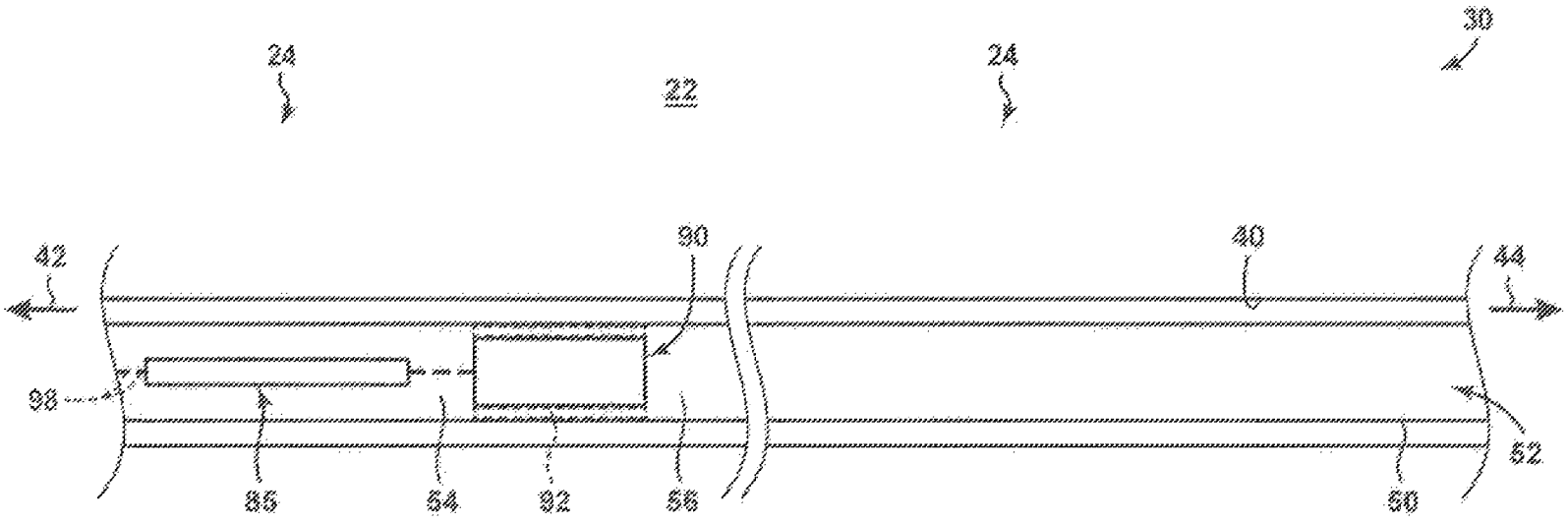
FIG. 14 is a schematic illustration of examples of another portion of the second process flow.

The retaining at 105 is illustrated schematically by the transition from the configuration that is illustrated in FIG. 3 to the configuration that is illustrated in FIG. 4 and also by the transition from the configuration that is illustrated in FIG. 13 to the configuration that is illustrated in FIG. 14. As illustrated in FIGS. 3 and 13, and prior to the retaining at 105, a sealing structure 90 may be positioned within tubular conduit 52 of tubular 50. In some examples, and as illustrated in dashed lines in FIGS. 4 and 14, the retaining at 105 may include retaining the sealing structure with, via, and/or utilizing a tether 98. In some examples, and as also illustrated in dashed lines in FIGS. 4 and 14, the retaining at 105 may include expanding a resilient sealing body 92 to operatively engage the sealing structure with the tubular.

The retaining at 105 may be performed with any suitable timing and/or sequence during methods 100. As examples, the retaining at 105 may be performed prior to the perforating at 110, prior to the stimulating at 115, prior to the propping at 120, prior to the fluidly isolating at 125, prior to the applying at 130, prior to the decreasing at 135, prior to the moving at 140, prior to the increasing at 145, prior to the maintaining at 150, prior to the repeating at 155, during the repeating at 155, prior to the abandoning at 160, and/or prior to the producing at 165.

Figure 15:
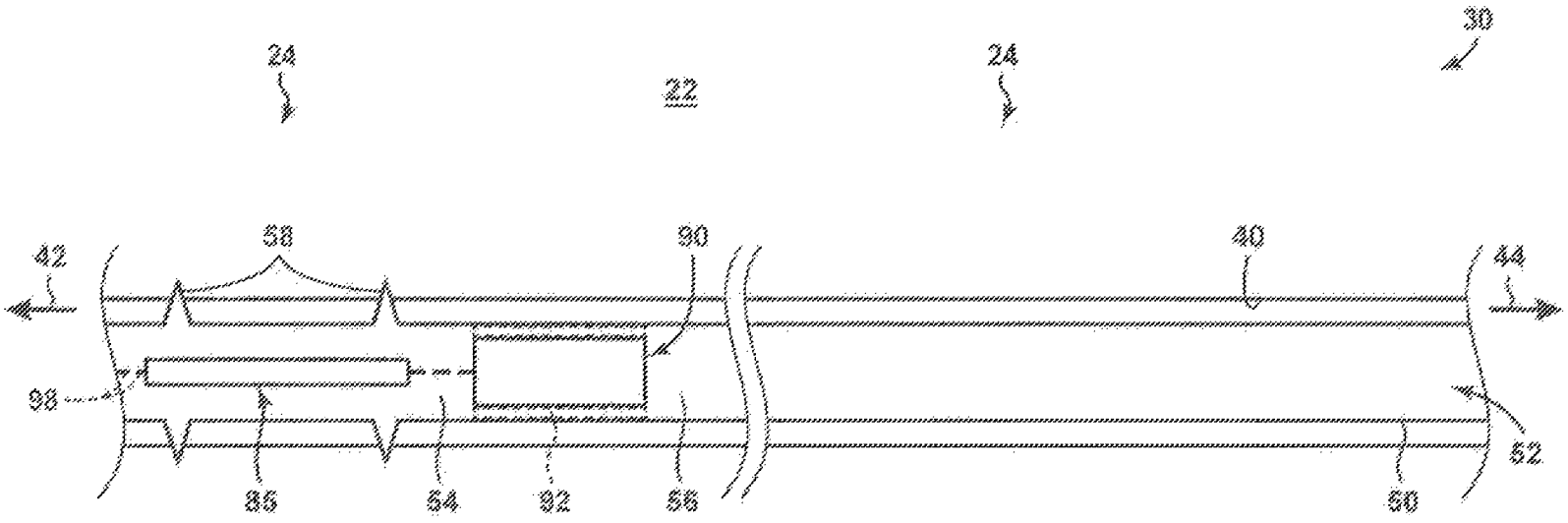
FIG. 15 is a schematic illustration of examples of another portion of the second process flow.

Perforating the tubular at 110 may include perforating the tubular with, via, and/or utilizing a perforation device. This may include perforating the tubular to form and/or define the plurality of perforations within the tubular. Examples of the perforation device are disclosed herein with reference to perforation device 85 of FIG. 1. The perforating at 110 is illustrated by the transition from the configuration that is illustrated in FIG. 14 to the configuration that is illustrated in FIG. 15. As illustrated therein, a perforation device 85 may be utilized to form and/or define a plurality of perforations 58 within tubular 50. As also illustrated, perforation device 85 may be operatively attached to a tether 98, which may be the same tether that may be operatively attached to sealing structure 90 or a different tether. Additionally or alternatively, perforation device 85 may be operatively attached to and/or may form a portion of sealing structure 90.

The perforating at 110 may be performed with any suitable timing and/or sequence during methods 100. As examples, the perforating at 110 may be performed subsequent to the retaining at 105, prior to the stimulating at 115, prior to the propping at 120, prior to the fluidly isolating at 125, prior to the applying at 130, prior to the decreasing at 135, prior to the moving at 140, prior to the increasing at 145, prior to the maintaining at 150, prior to the repeating at 155, during the repeating at 155, prior to the abandoning at 160, and/or prior to the producing at 165.

Stimulating the zone of a subterranean formation at 115 may include stimulating the zone of the subterranean with a stimulant fluid stream. As an example, the stimulating at 115 may include providing the stimulant fluid stream to the uphole region of the tubular conduit. As another example, the stimulating at 115 may include flowing the stimulant fluid stream into the zone of the subterranean formation via the plurality of perforations. The plurality of perforations may be defined within a portion of the tubular that defines the uphole region of the tubular conduit.

Figure 5:
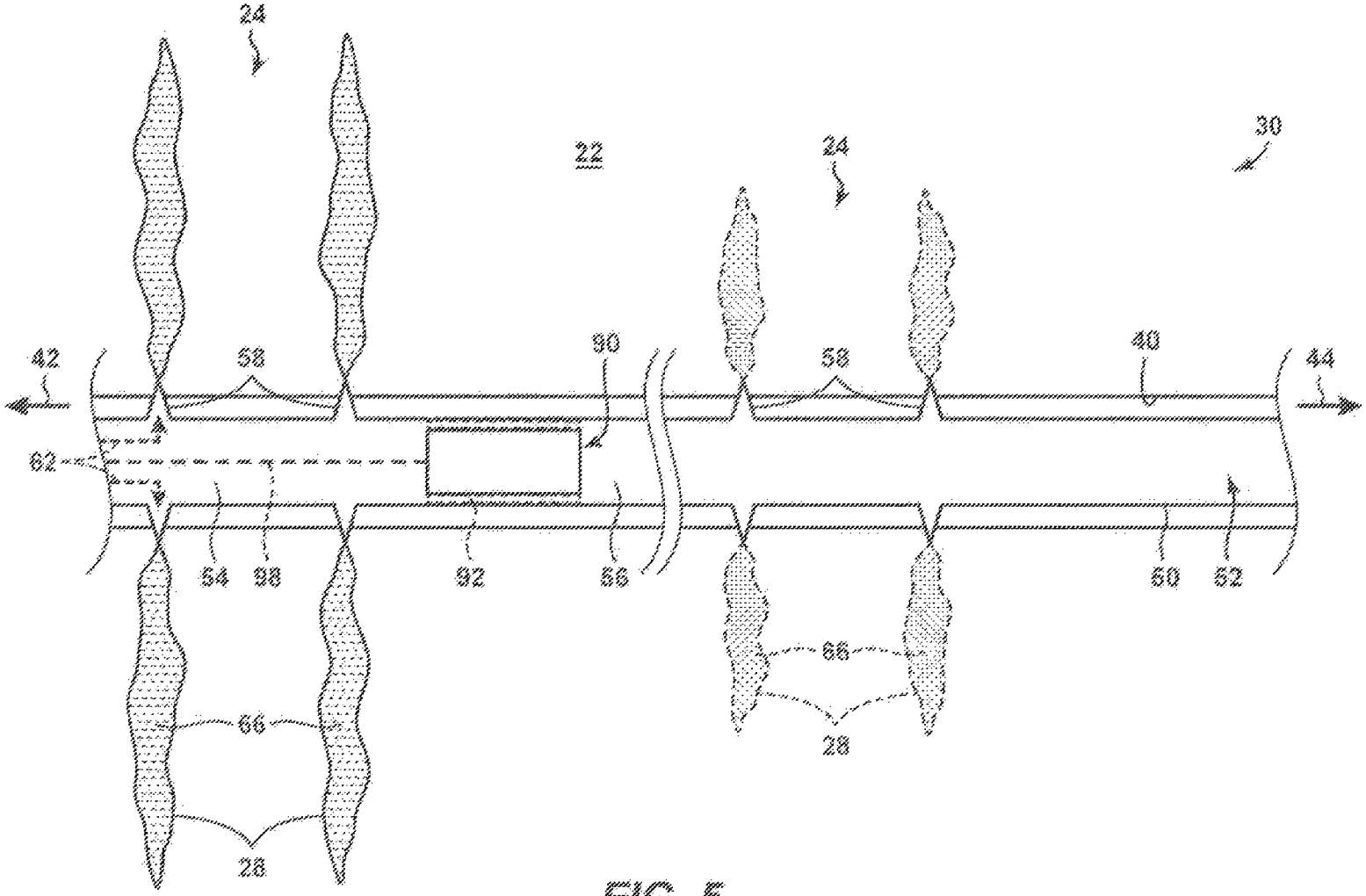
FIG. 5 is a schematic illustration of examples of another portion of the first process flow.

In some examples, the stimulating at 115 may include expanding, or increasing a size of, at least one fracture within the zone of the subterranean formation. This is illustrated schematically by the transition from the configuration that is illustrated in FIG. 4 to the configuration that is illustrated in FIG. 5. More specifically, FIG. 4 illustrates optional previously formed fractures 28 in dashed lines, while FIG. 5 illustrates supply of stimulant fluid stream 62 to zone 24 of subterranean formation 22 via perforations 58 to expand and/or increase the size of the fractures, as illustrated in solid lines in FIG. 5.

Figure 16:
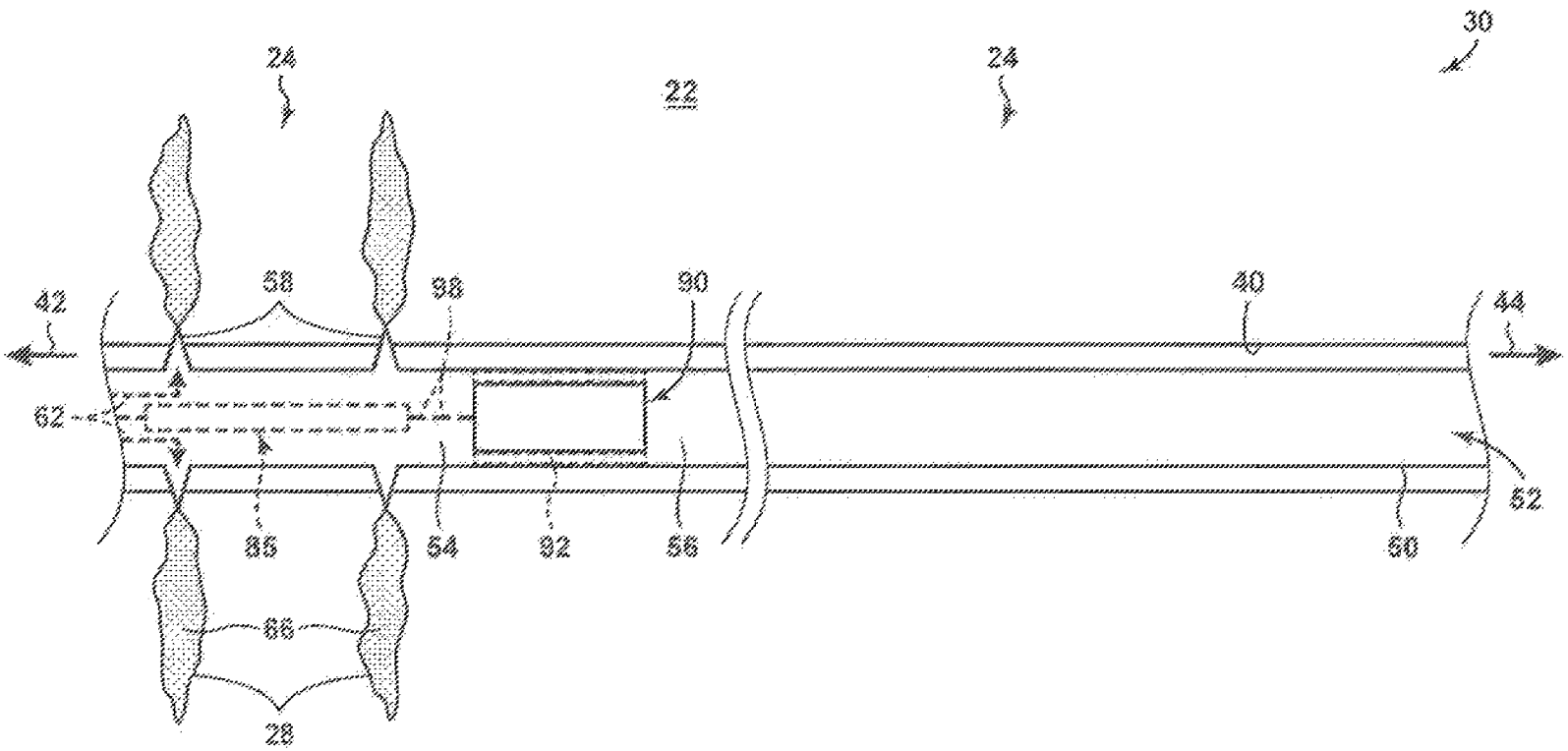
FIG. 16 is a schematic illustration of examples of another portion of the second process flow.

In some examples, the stimulating at 115 may include creating at least one fracture within the zone of the subterranean formation. This is illustrated schematically by the transition from FIG. 4 to the configuration that is illustrated in FIG. 5 and also by the transition from the configuration that is illustrated in FIG. 15 to the configuration that is illustrated in FIG. 16. More specifically, and absent optional previously formed fractures 28 in FIGS. 4-5, both transitions illustrate supply of stimulant fluid stream 62 to zone 24 of subterranean formation 22 via perforations 58 to form and/or define fractures 28, as illustrated in solid lines in FIGS. 5 and 16.

The stimulant fluid stream may include a liquid, such as water. The liquid may pressurize the zone of the subterranean formation, thereby forming and/or expanding the fracture. The stimulant fluid stream additionally or alternatively may include a proppant.

The stimulating at 115 may include providing the stimulant fluid stream in any suitable manner, at any suitable stimulant stream flow rate, and/or at any suitable stimulant stream pressure. As an example, the stimulating at 115 may include providing the stimulant fluid stream with, via, and/or utilizing a stimulant fluid supply system, examples of which are disclosed herein with reference to stimulant fluid supply system 60 of FIG. 1. Examples of the stimulant stream flow rate include flow rates of at least 0.025 cubic meters per minute, at least 0.05 cubic meters per minute, at least 0.075 cubic meters per minute, at least 0.1 cubic meters per minute, at least 0.125 cubic meters per minute, at least 0.15 cubic meters per minute, at most 0.3 cubic meters per minute, at most 0.25 cubic meters per minute, at most 0.2 cubic meters per minute, at most 0.15 cubic meters per minute, and/or at most 0.1 cubic meters per minute. Examples of the stimulant stream pressure include pressures of at least 4 Megapascals (MPa), at least 5 MPa, at least 6 MPa, at least 7 MPa, at least 8 MPa, at least 9 MPa, at least 10 MPa, at most 20 MPa, at most 18 MPa, at most 16 MPa, at most 14 MPa, at most 12 MPa, and/or at most 10 MPa.

The stimulating at 115 may be performed with any suitable timing and/or sequence during methods 100. As examples, the stimulating at 115 may be performed subsequent to the retaining at 105, subsequent to the perforating at 110, prior to the propping at 120, at least partially concurrently with the propping at 120, prior to the fluidly isolating at 125, prior to the applying at 130, prior to the decreasing at 135, prior to the moving at 140, prior to the increasing at 145, prior to the maintaining at 150, prior to the repeating at 155, during the repeating at 155, prior to the abandoning at 160, and/or prior to the producing at 165.

When the stimulant fluid stream includes the proppant, methods 100 also may include propping the fracture at 120. The propping at 120 may include positioning the proppant within the at least one fracture to prop the fracture, to decrease a potential for closure of the fracture, to decrease a magnitude of closure of the fracture, and/or to increase a fluid permeability of the fracture. The propping at 120 is illustrated in FIGS. 5 and 16, with proppant 66 being positioned within fractures 28. In some examples, the proppant may be flowed into the fractures in and/or within the stimulant fluid stream.

The propping at 120 may be performed with any suitable timing and/or sequence during methods 100. As examples, the propping at 120 may be performed subsequent to the retaining at 105, subsequent to the perforating at 110, subsequent to the stimulating at 115, at least partially concurrently with the stimulating at 115, prior to the fluidly isolating at 125, prior to the applying at 130, prior to the decreasing at 135, prior to the moving at 140, prior to the increasing at 145, prior to the maintaining at 150, prior to the repeating at 155, during the repeating at 155, prior to the abandoning at 160, and/or prior to the producing at 165.

Fluidly isolating the zone of the subterranean formation at 125 may include fluidly isolating the zone of the subterranean formation from the uphole region by at least partially, or even completely, blocking, occluding, and/or sealing the plurality of perforations. This may include at least partially sealing the plurality of perforations with a plurality of diversion structures, examples of which are disclosed herein with reference to diversion structures 80 of FIG. 1. The fluidly isolating at 125 may include operatively engaging the tubular with the plurality of diversion structures such that a corresponding diversion structure of the plurality of diversion structures is positioned at least partially within and/or obstructs each perforation of the plurality of perforations during the repeating at 155.

Figure 6:
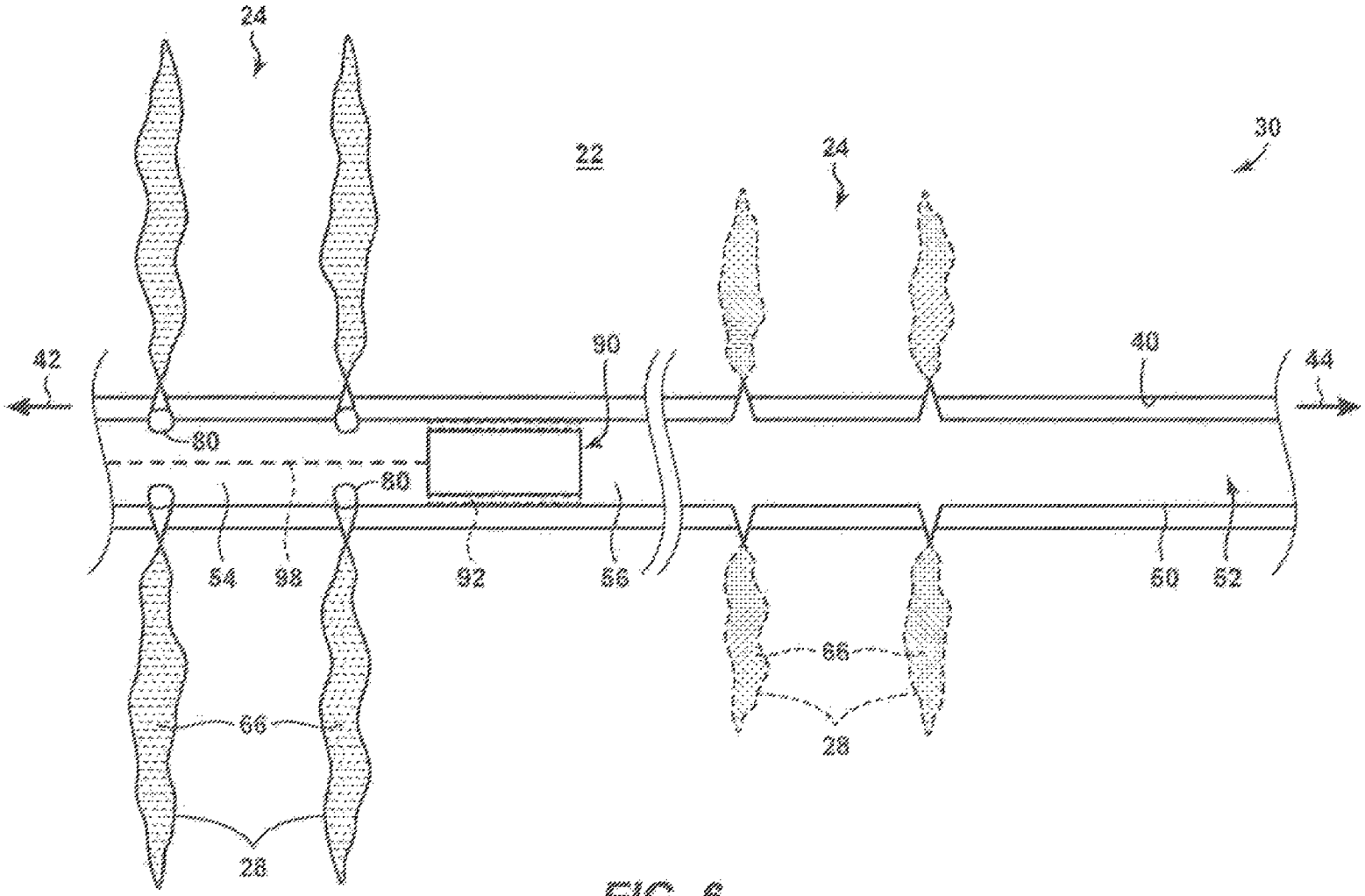
FIG. 6 is a schematic illustration of examples of another portion of the first process flow.
Figure 17:
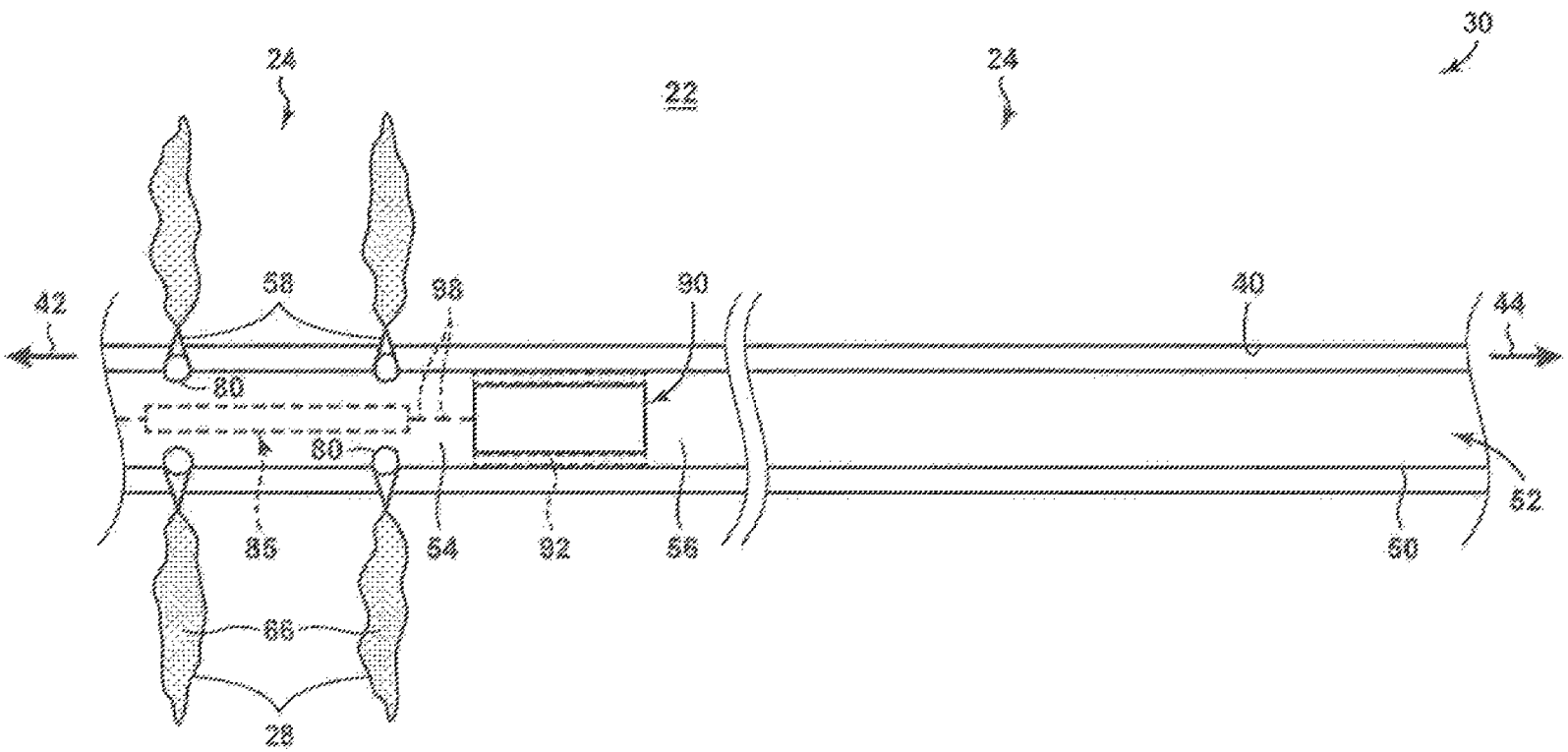
FIG. 17 is a schematic illustration of examples of another portion of the second process flow.

The fluidly isolating at 125 is illustrated schematically by the transition from the configuration that is illustrated in FIG. 5 to the configuration that is illustrated in FIG. 6 and also by the transition from the configuration that is illustrated in FIG. 16 to the configuration that is illustrated in FIG. 17. More specifically, FIGS. 6 and 17 illustrate corresponding diversion structures 80 associated with each perforation 58 within uphole region 54 and fluidly isolating zone 24 from the uphole region of the tubular conduit.

The fluidly isolating at 125 may be performed with any suitable timing and/or sequence during methods 100. As examples, the fluidly isolating at 125 may be performed subsequent to the retaining at 105, subsequent to the perforating at 110, subsequent to the stimulating at 115, at least partially concurrently with the stimulating at 115, subsequent to the propping at 120, at least partially concurrently with the propping at 120, prior to the applying at 130, prior to the decreasing at 135, prior to the moving at 140, prior to the increasing at 145, prior to the maintaining at 150, prior to the repeating at 155, during the repeating at 155, prior to the abandoning at 160, and/or prior to the producing at 165.

Applying the motive force to the sealing structure at 130 may include applying the motive force to produce, to generate, and/or to facilitate the moving at 140. In some examples, the applying at 130 may include generating the motive force. The generating may include generating the motive force in any suitable manner, such as electrically, hydraulically, pneumatically, mechanically, and/or hydrostatically. In some examples, and as discussed herein with reference to FIG. 1, the applying at 130 may include providing a motive fluid stream to the upper region of the tubular conduit. In some examples, and as discussed herein with reference to FIG. 1, the applying at 130 may include generating the motive force with a tractor of the sealing structure. An example of the applying at 130 is illustrated in FIGS. 7-8 and 18-19 and discussed in more detail herein with reference to the moving at 140. More specifically, FIGS. 7-8 and 18-19 illustrate supply of a motive fluid stream 72 to provide the motive force.

The applying at 130 may be performed with any suitable timing and/or sequence during methods 100. As examples, the applying at 130 may be performed subsequent to the retaining at 105, subsequent to the perforating at 110, subsequent to the stimulating at 115, subsequent to the propping at 120, subsequent to the fluidly isolating at 125, prior to the decreasing at 135, prior to the moving at 140, prior to the increasing at 145, at least partially concurrently with the maintaining at 150, prior to the repeating at 155, during the repeating at 155, prior to the abandoning at 160, and/or prior to the producing at 165.

Decreasing the pressure within a wellbore fluid at 135 may include decreasing the pressure within any suitable wellbore fluid, which extends within the wellbore and/or in fluid contact with the sealing structure. This may include decreasing the pressure within the wellbore fluid to less than a threshold move initiation pressure, such as by decreasing a flow rate of the stimulant fluid stream and/or of the motive fluid stream to the upper region of the tubular conduit. As discussed in more detail herein, with reference to the moving at 140, the sealing structure may be configured to initiate the moving at 140 responsive to the decreasing at 135.

The decreasing at 135 may be performed with any suitable timing and/or sequence during methods 100. As examples, the decreasing at 135 may be performed subsequent to the retaining at 105, subsequent to the perforating at 110, subsequent to the stimulating at 115, subsequent to the propping at 120, subsequent to the fluidly isolating at 125, subsequent to the applying at 130, at least partially concurrently with the applying at 130, prior to the applying at 130, prior to the moving at 140, prior to the increasing at 145, at least partially concurrently with the maintaining at 150, prior to the repeating at 155, during the repeating at 155, prior to the abandoning at 160, and/or prior to the producing at 165.

Moving the sealing structure at 140 may include moving the sealing structure within the tubular conduit. The moving at 140 may include moving the sealing structure in a downhole direction.

In some examples, and as discussed, the sealing structure may be operatively attached to a tether, such as tether 98 of FIG. 1. In some such examples, the moving at 140 may include moving with, via, and/or utilizing the tether. As an example, the moving at 140 may include extending the tether into the tubular conduit and/or increasing a magnitude of a length of the tether that extends within the tubular conduit. In some such examples, and when methods 100 include the applying at 130, the moving at 140 may include providing the motive fluid stream to the uphole region of the tubular conduit and flowing the sealing structure in the downhole direction in and/or within the motive fluid stream. In some such examples, the repeating the retaining may include ceasing extension of the tether into the tubular conduit.

In some examples, the sealing structure may include and/or be an autonomous sealing structure. Stated another way, the sealing structure may not be operatively attached to the tether and/or may be configured to at least partially independently perform the moving at 140. In some such examples, and as discussed, the sealing structure may include a tractor, such as tractor 96 of FIG. 1. In some such examples, the moving at 140 may include moving with, via, and/or utilizing the tractor.

In some examples, the sealing structure may include and/or be a pressure-actuated stealing structure, which may be configured to perform the moving at 140 at least partially responsive to a pressure within the wellbore fluid that surrounds the sealing structure and/or that extends within the tubular conduit. In some such examples, the applying at 130 may include providing the motive fluid stream to the uphole region of the tubular conduit to provide a motive force for the moving at 140.

In some examples, the sealing structure, or the pressure-actuated sealing structure, may be configured to initiate the moving at 140 responsive, or at least partially responsive, to the pressure within the wellbore fluid being greater than a threshold move initiation pressure. In some such examples, the threshold move initiation pressure may be greater than a stimulant stream pressure of the stimulant fluid stream during the stimulating at 115. Such a configuration may permit the sealing structure to be retained within the tubular conduit subsequent to the retaining at 105 and during the stimulating at 115. Such a configuration also may permit the sealing structure to move in the downhole direction during the moving at 140. In some such examples, the threshold move initiation pressure may be less than a stall pressure of a pump that is utilized to provide the stimulant fluid stream to the tubular conduit during the stimulating at 115. Such a configuration may permit the pump to both perform the stimulating at 115 and initiate the moving at 140.

In some such examples, the sealing structure may be configured to initiate the repeating the retaining at 105 responsive to the pressure within the wellbore fluid being less than a threshold retaining pressure. The threshold retaining pressure may be less than the threshold move initiation pressure. Such a configuration may permit and/or facilitate pressure-controlled and/or pressure-regulated motion of the sealing structure within the tubular conduit and/or in the downhole direction.

As an example, and subsequent and/or responsive to the fluidly isolating at 125, the pressure within the wellbore fluid may be increased to be greater than the threshold move initiation pressure. Responsive to the pressure within the wellbore fluid being greater than the threshold move initiation pressure, the sealing structure may initiate motion in the downhole direction within the tubular conduit. As the sealing structure moves in the downhole direction, the sealing structure may move past a plurality of downhole perforations, which may be downhole from the plurality of perforations utilized during the stimulating at 115 and/or sealed during the fluidly isolating at 125. Responsive to motion of the sealing structure past the plurality of downhole perforations, methods 100 further may include flowing a fraction of the wellbore fluid from the tubular conduit via the plurality of downhole perforations and decreasing the pressure within the wellbore fluid, such as to a pressure that is less than the threshold retaining pressure. The sealing structure then may repeat the retaining at 105 at least partially responsive to the decreasing the pressure.

In some examples, the sealing structure, or the pressure-actuated sealing structure, may be configured to initiate the moving at 140 responsive to the pressure within the wellbore fluid being less than the threshold move initiation pressure. In some such examples, methods 100 may include performing the decreasing at 135 to initiate the moving at 140. This may include, for example, decreasing a supply rate of the motive fluid stream to the uphole region of the tubular conduit to decrease the pressure within the wellbore fluid below the threshold move initiation pressure.

In some such examples, the threshold move initiation pressure may be less than the stimulant stream pressure of the stimulant fluid stream during the stimulating at 115. As such, and subsequent to the retaining at 105, the sealing structure may remain retained within the tubular conduit until the decreasing at 135 is performed. In some such examples, the sealing structure may be configured to repeat the retaining at 105, or to initiate repeating the retaining at 105, during the repeating at 155 and/or responsive to the pressure within the wellbore fluid being greater than the threshold retaining pressure. The threshold retaining pressure may be greater than the threshold move initiation pressure. In some such examples, and subsequent to the moving at 140, methods 100 further may include performing the increasing at 145 to increase the pressure within the wellbore fluid to be greater than the threshold retaining pressure.

As discussed, the moving at 140 includes moving the sealing structure in the downhole direction. This may include moving the sealing structure in the downhole direction during each instance of the moving at 140, such as may be performed during the repeating at 155.

The moving at 140 may include moving the sealing structure at least a threshold downhole distance. Examples of the threshold downhole distance include distances of at least 4 meters, at least 6 meters, at least 8 meters, at least 10 meters, at least 15 meters, at least 20 meters, at least 30 meters, at least 40 meters, at least 60 meters, at most 100 meters, at most 80 meters, at most 60 meters, at most 50 meters, and/or at most 40 meters.

The moving at 140 may include moving the sealing structure past at least a threshold number of perforations, which may be defined within the tubular. Examples of the threshold number of perforations include at least 2, at least 4, at least 6, at least 8, at least 10, at least 15, at least 20, at most 50, at most 40, at most 30, at most 20, and/or at most 10 perforations.

Figure 7:
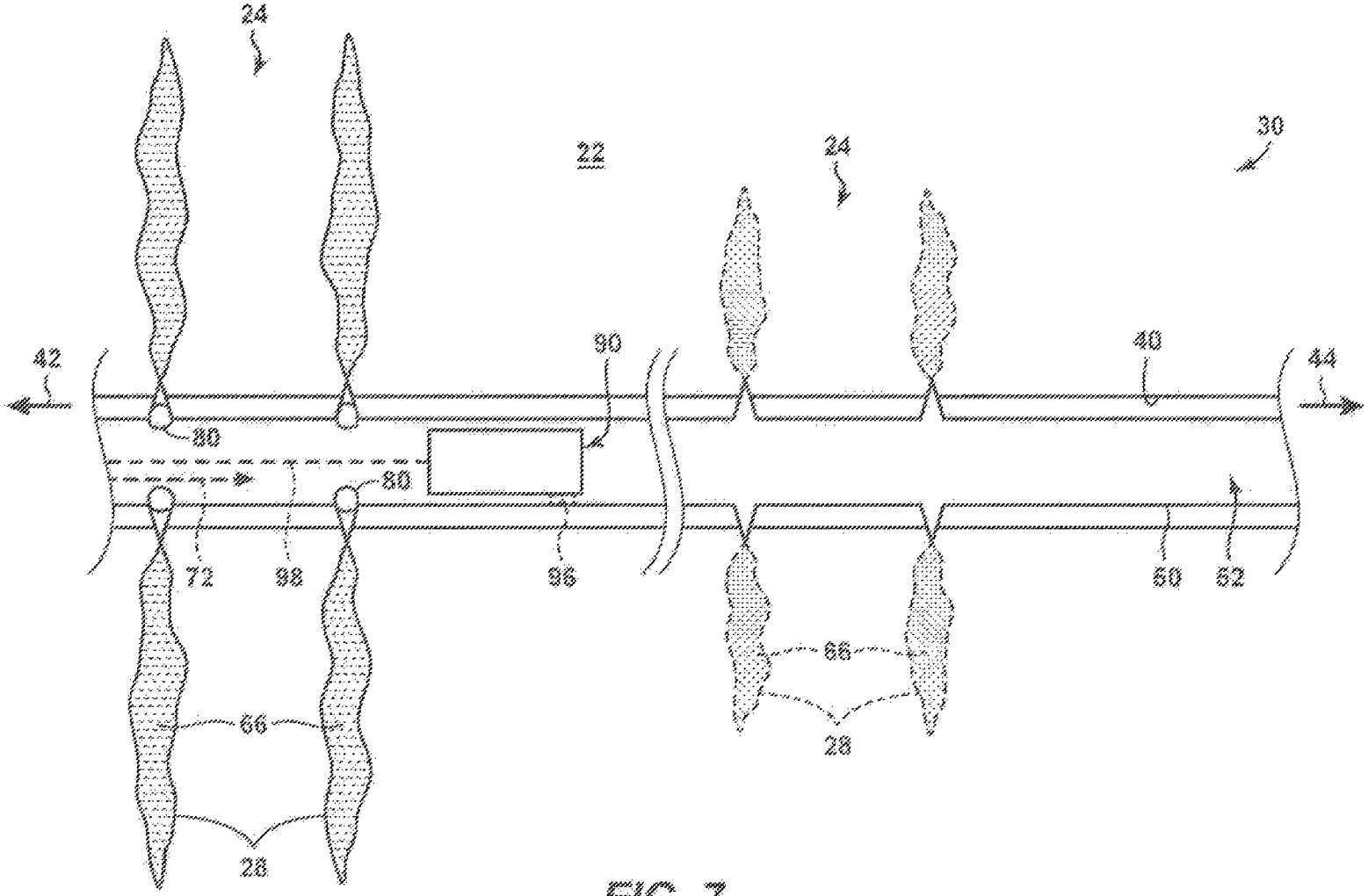
FIG. 7 is a schematic illustration of examples of another portion of the first process flow.
Figure 8:
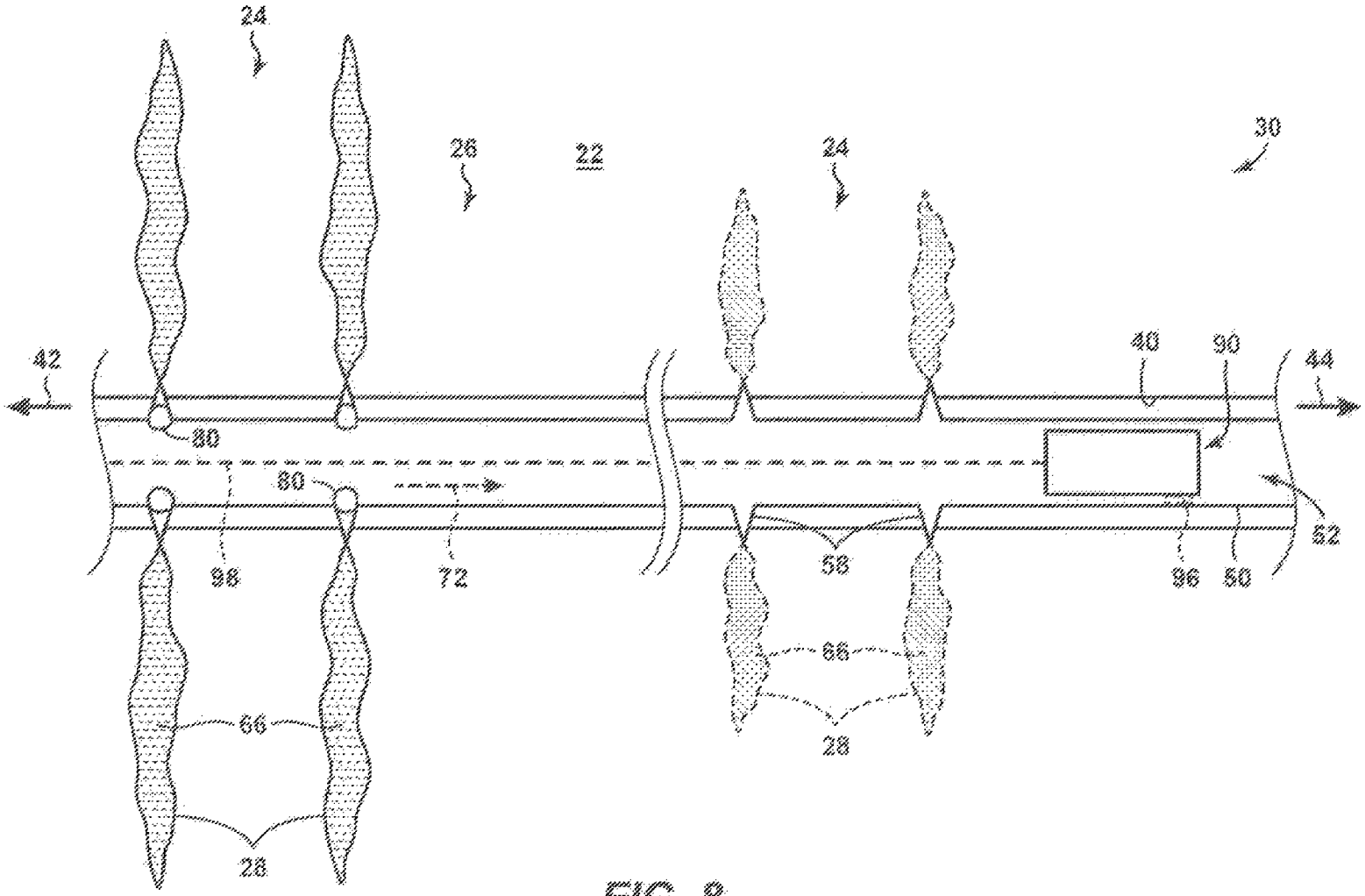
FIG. 8 is a schematic illustration of examples of another portion of the first process flow.
Figure 18:
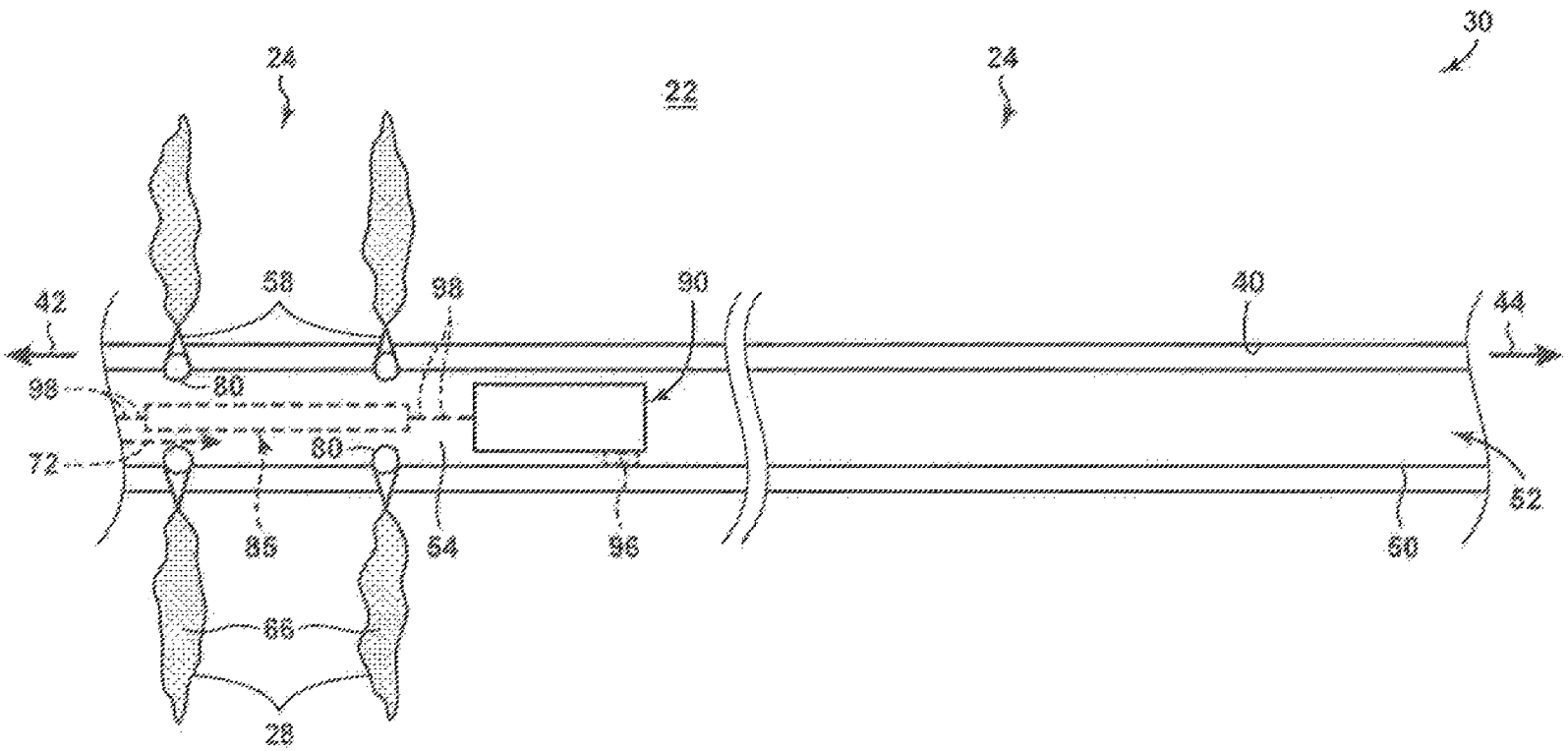
FIG. 18 is a schematic illustration of examples of another portion of the second process flow.
Figure 19:
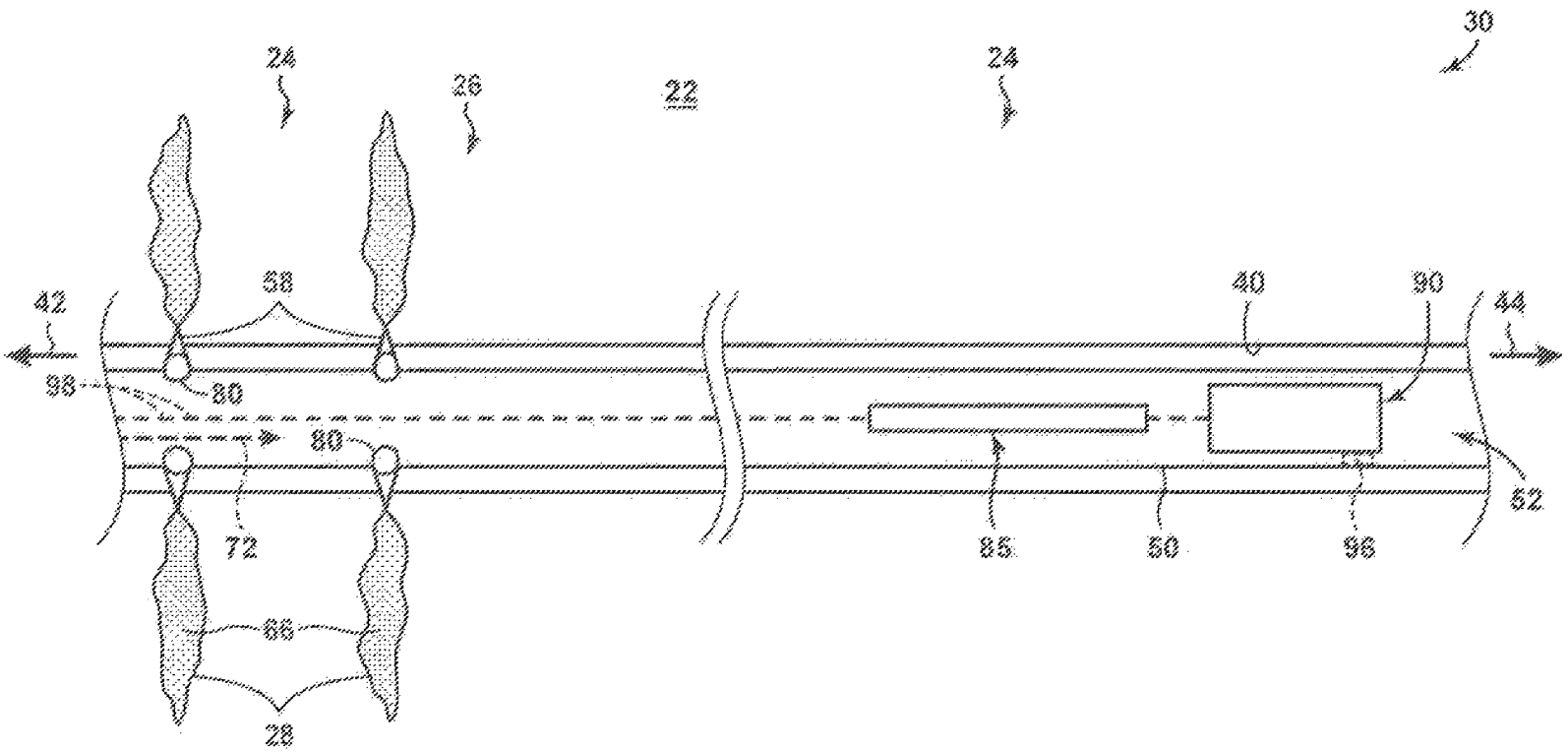
FIG. 19 is a schematic illustration of examples of another portion of the second process flow.

The moving at 140 is illustrated schematically by the progression from FIG. 6 to FIG. 7 to FIG. 8 and also by the progression from FIG. 17 to FIG. 18 to FIG. 19. As illustrated in FIGS. 6 and 17, sealing structure 90 initially may be retained within tubular conduit 52. In some examples, this retention may be via tether 98. In some examples, this retention may be via operative engagement with tubular 50, such as via a resilient sealing body 92. Then, and as illustrated in FIGS. 7 and 18, the sealing structure may be transitioned to a configuration in which it is free to move within the tubular conduit, such as via retraction of the resilient sealing body and/or via extension of the tether into the tubular conduit. This may permit and/or facilitate motion of sealing structure 90 in downhole direction 44, which may be accomplished via supply of motive fluid stream 72 and/or utilizing a tractor 96 that may be associated with the sealing structure. As illustrated by the transition from the configuration that is illustrated in FIG. 7 to the configuration that is illustrated in FIG. 8, the moving at 140 may, in some examples, include moving the sealing structure past at least a threshold number of perforations 58. Additionally or alternatively, and as illustrated by the transition from the configuration that is illustrated in FIG. 18 to the configuration that is illustrated in FIG. 19, the moving at 140 may include moving the sealing structure to an unperforated region of the tubular.

The moving at 140 may be performed with any suitable timing and/or sequence during methods 100. As examples, the moving at 140 may be performed subsequent to the retaining at 105, subsequent to the perforating at 110, subsequent to the stimulating at 115, subsequent to the propping at 120, subsequent to the fluidly isolating at 125, subsequent to the applying at 130, at least partially concurrently with the applying at 130, subsequent to the decreasing at 135, at least partially concurrently with the increasing at 145, prior to the increasing at 145, at least partially concurrently with the maintaining at 150, prior to the repeating at 155, during the repeating at 155, prior to the abandoning at 160, and/or prior to the producing at 165.

Increasing the pressure within the wellbore fluid at 145 may include increasing the pressure within the wellbore fluid to be greater than the threshold retaining pressure, such as to permit and/or facilitate repeating the retaining at 105 during the repeating at 155. The increasing at 145 may be accomplished in any suitable manner. As an example, the increasing at 145 may include increasing the flow rate of the stimulant fluid stream and/or of the motive fluid stream to the uphole region of the tubular conduit.

The increasing at 145 may be performed with any suitable timing and/or sequence during methods 100. As examples, the increasing at 145 may be performed subsequent to the retaining at 105, subsequent to the perforating at 110, subsequent to the stimulating at 115, subsequent to the propping at 120, subsequent to the fluidly isolating at 125, subsequent to the applying at 130, at least partially concurrently with the applying at 130, subsequent to the decreasing at 135, subsequent to the moving at 140, at least partially concurrently with the moving at 140, at least partially concurrently with the maintaining at 150, prior to the repeating at 155, during the repeating at 155, prior to the abandoning at 160, and/or prior to the producing at 165.

Maintaining the fluid seal at 150 may include maintaining the at least partial fluid seal of the plurality of perforations. This may include maintaining operative engagement between the plurality of diversion structures and the plurality of perforations and may be performed continuously, or at least substantially continuously, during at least a subset of methods 100.

The maintaining at 150 is illustrated schematically by the progression from FIG. 6 to FIG. 7 to FIG. 8 and also by the progression from FIG. 17 to FIG. 18 to FIG. 19. As illustrated therein, the at least partial fluid seal, which is formed by diversion structures 80, may be maintained at least during the applying at 130 and the moving at 140.

The maintaining at 150 may be performed with any suitable timing and/or sequence during methods 100. As examples, the maintaining at 150 may be performed subsequent to the retaining at 105, subsequent to the perforating at 110, subsequent to the stimulating at 115, subsequent to the propping at 120, subsequent to the fluidly isolating at 125, responsive to the fluidly isolating at 125, at least partially concurrently with and/or during the applying at 130, at least partially concurrently with and/or during the decreasing at 135, at least partially concurrently with and/or during the moving at 140, at least partially concurrently with and/or during the increasing at 145, at least partially concurrently with and/or during the repeating at 155, prior to the abandoning at 160, and/or prior to the producing at 165.

Repeating at least the portion of the methods at 155 may include repeating at least the retaining at 105, the stimulating at 115, the fluidly isolating at 125, and the moving at 140 a plurality of times, such as to stimulate, or to sequentially stimulate, a plurality of corresponding zones of the subterranean formation. This may include performing the moving at 140 subsequent to each instance of the stimulating at 115 and/or subsequent to each instance of the fluidly isolating at 125, as performed during the repeating at 155.

As discussed in more detail herein, the repeating at 155 may include sequentially moving the sealing structure, or a single sealing structure, in the downhole direction. This may permit and/or facilitate stimulation of at least a desired region of the subterranean formation utilizing only the single sealing structure and/or without utilizing a plurality of distinct sealing structures. This may permit and/or facilitate the abandoning at 160 and/or may permit and/or facilitate transitioning from the repeating at 155 to the producing at 165 without removing the sealing structure from the tubular conduit.

Figure 9:
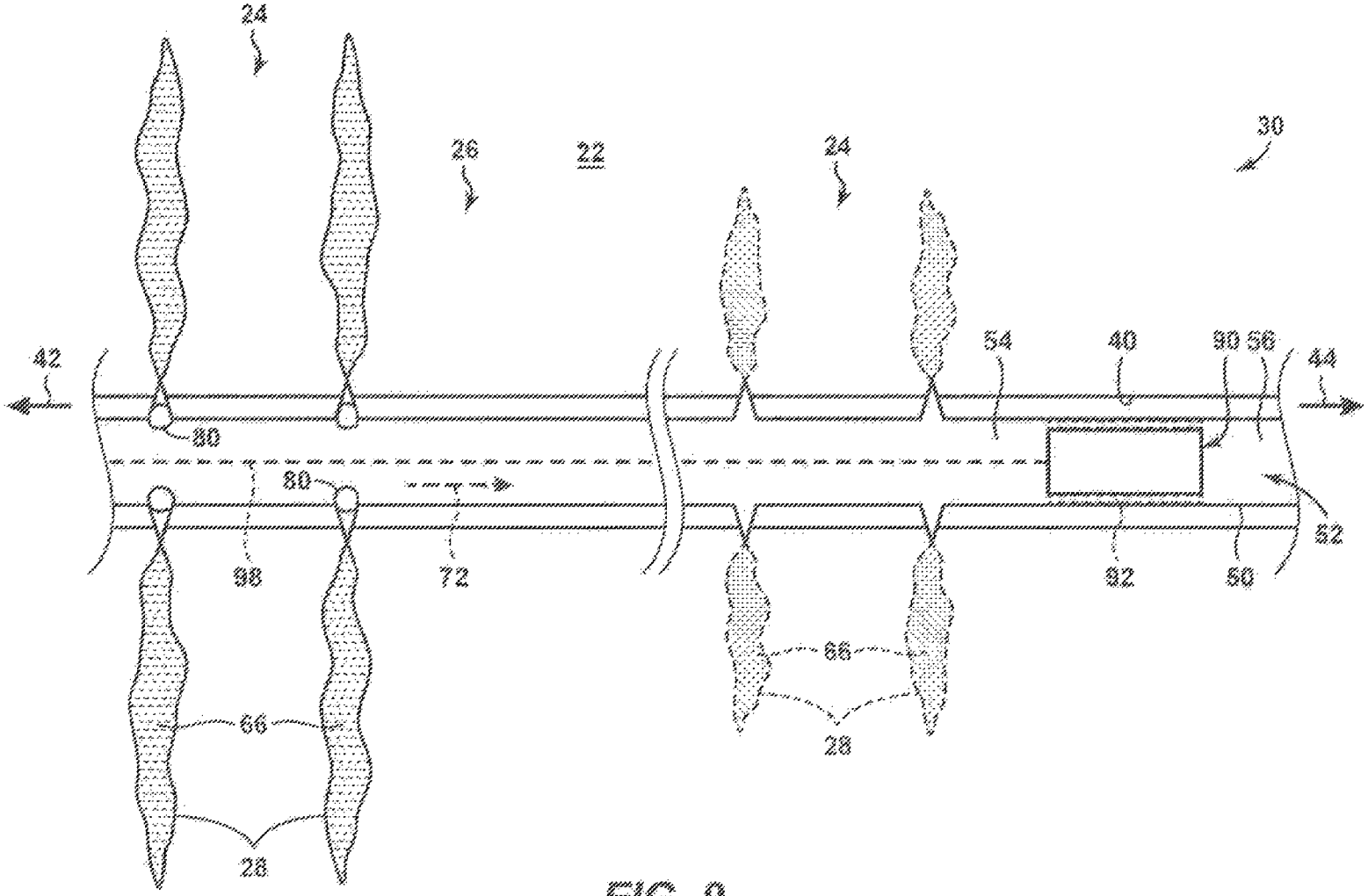
FIG. 9 is a schematic illustration of examples of another portion of the first process flow.
Figure 10:
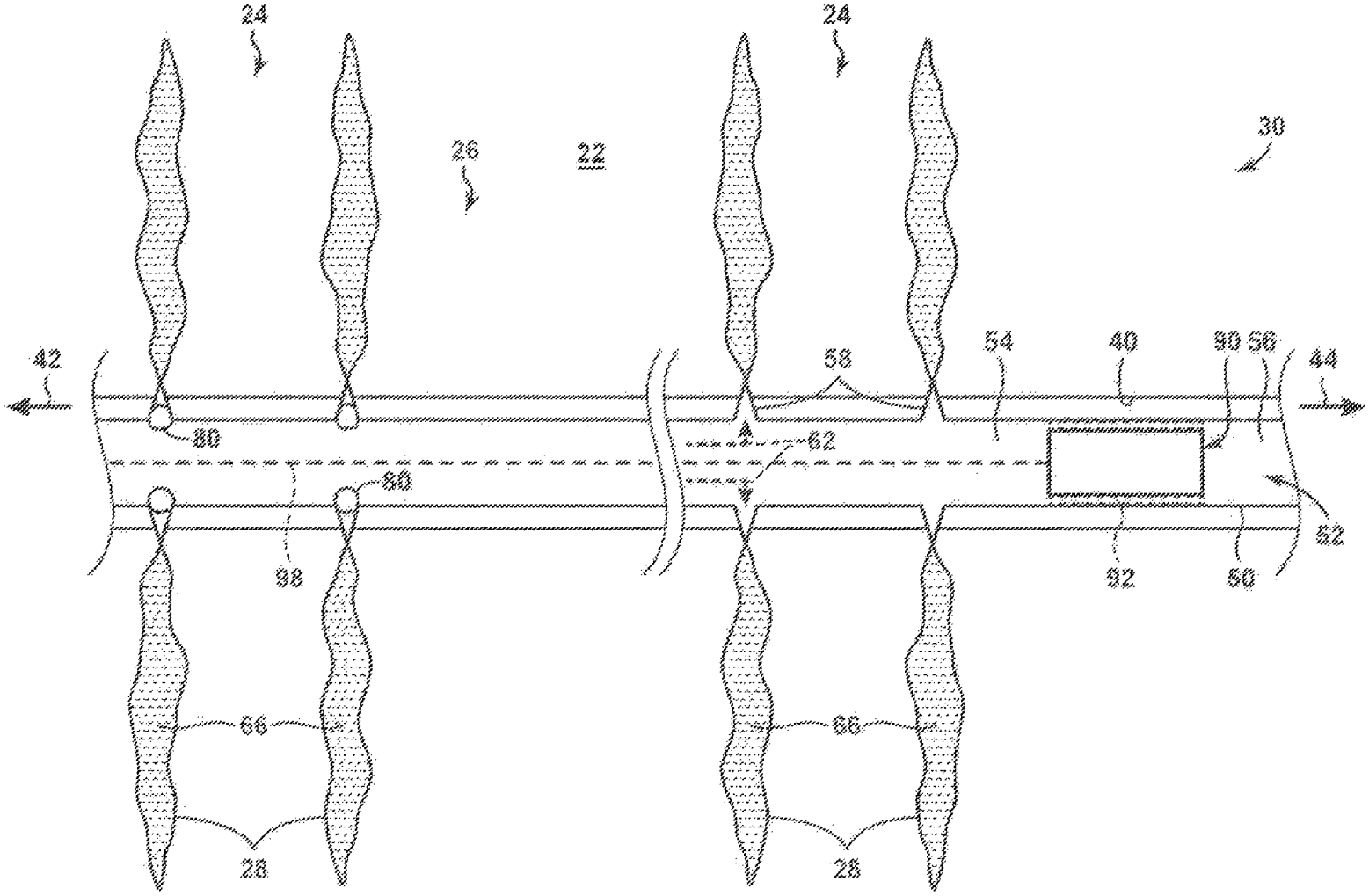
FIG. 10 is a schematic illustration of examples of another portion of the first process flow.
Figure 11:
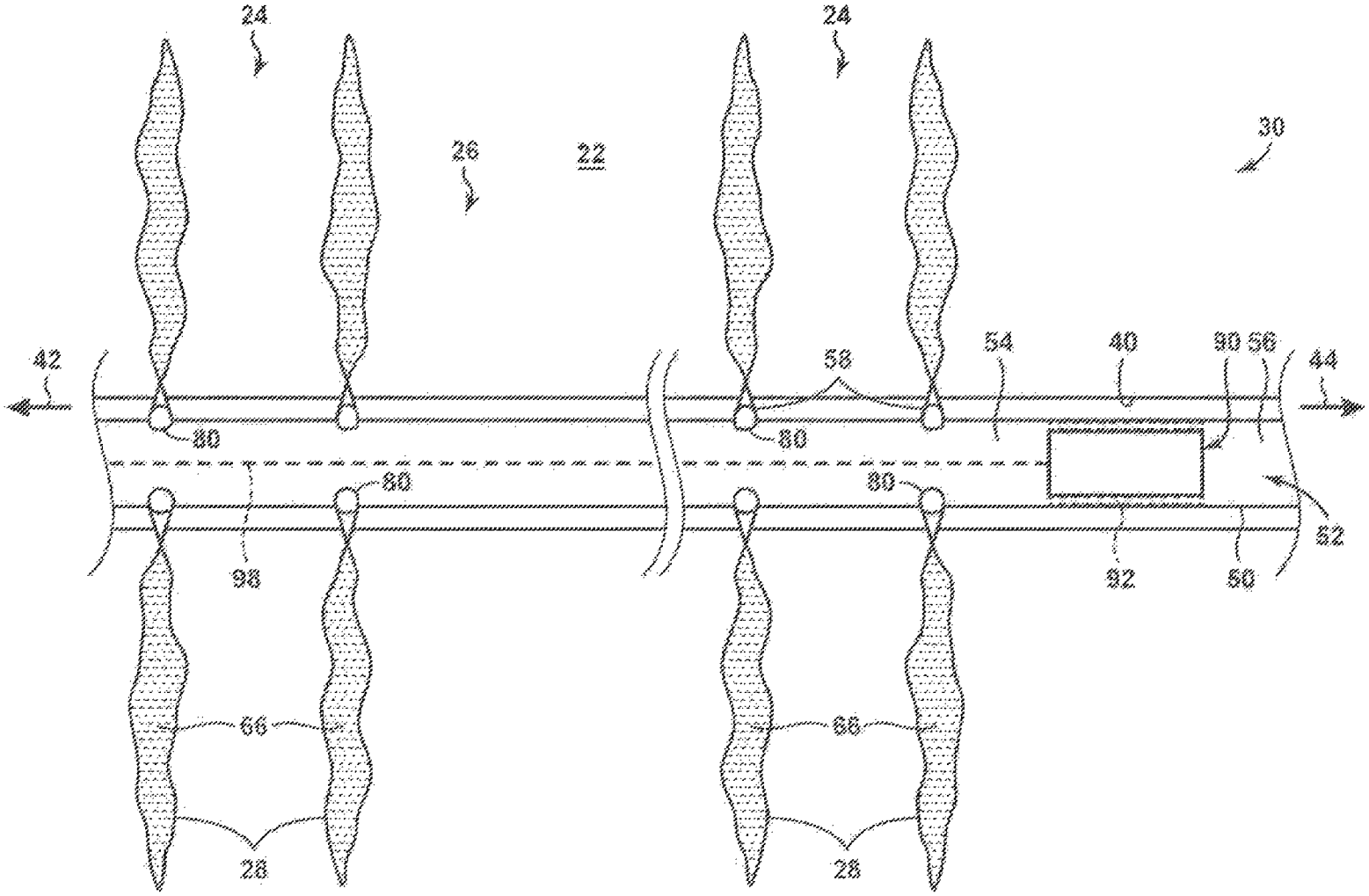
FIG. 11 is a schematic illustration of examples of another portion of the first process flow.
Figure 12:
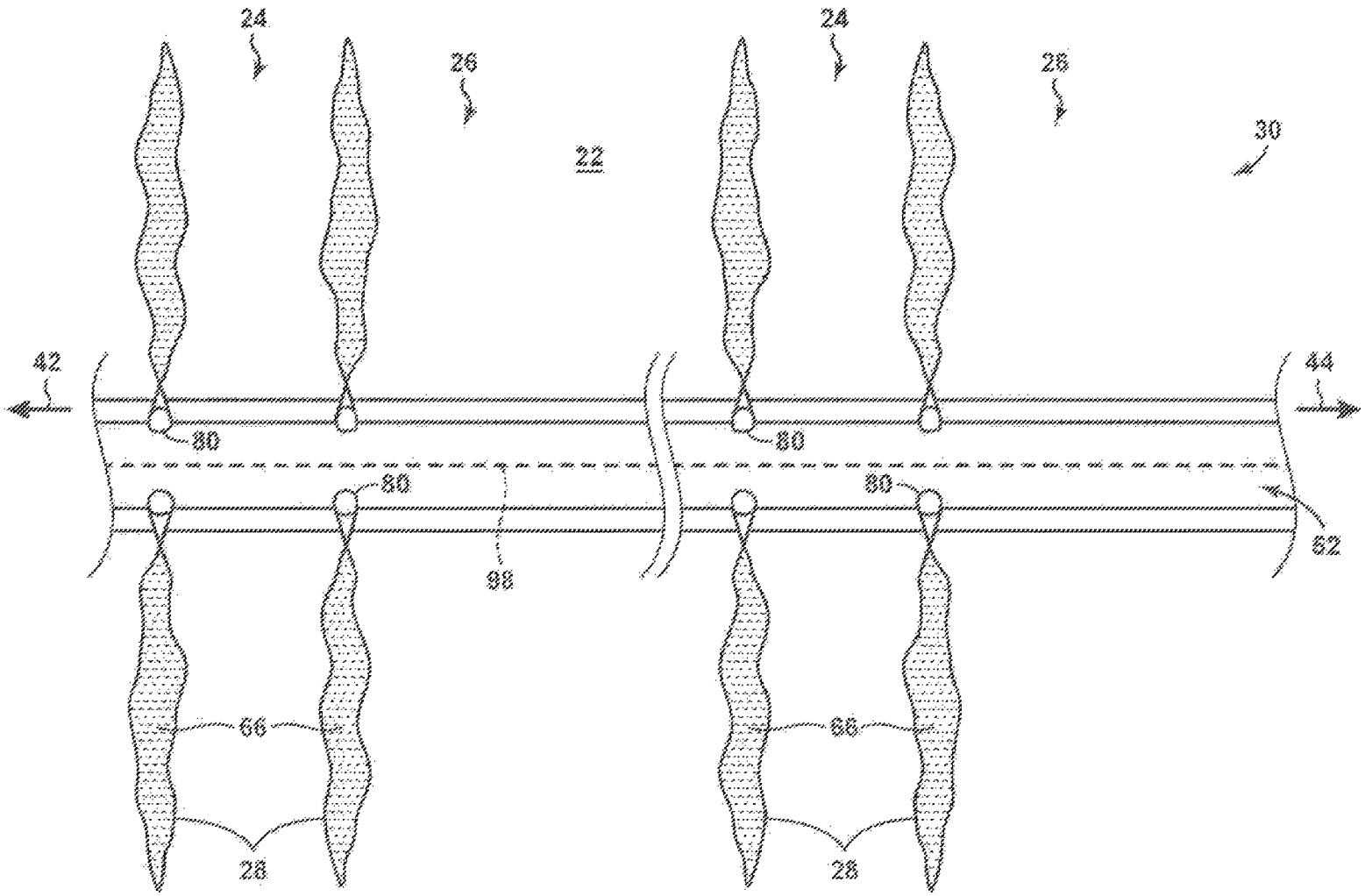
FIG. 12 is a schematic illustration of examples of another portion of the first process flow.

One instance of an example of the repeating at 155 is illustrated schematically by the progression from FIG. 9 to FIG. 10 to FIG. 11 to FIG. 12 and also by the progression from FIG. 20 to FIG. 21 to FIG. 22 to FIG. 23 to FIG. 24. Referring first to the progression illustrated by FIGS. 9-12, and in examples of methods 100 performed in previously perforated tubulars 50, FIG. 9 illustrates repeating the retaining at 105 to retain sealing structure 90 within the tubular conduit and at least partially fluidly isolate uphole region 54 from downhole region 56. FIG. 10 then illustrates repeating the stimulating at 115 by providing stimulant fluid stream 62 to a corresponding zone 24 of subterranean formation 22 via perforations 58. FIG. 11 then illustrates repeating the fluidly isolating at 125 by engaging corresponding diversion structures 80 with perforations 58. FIG. 12 then illustrates repeating the moving at 140 by moving sealing structure 90 further downhole within tubular conduit 52.

Figure 20:
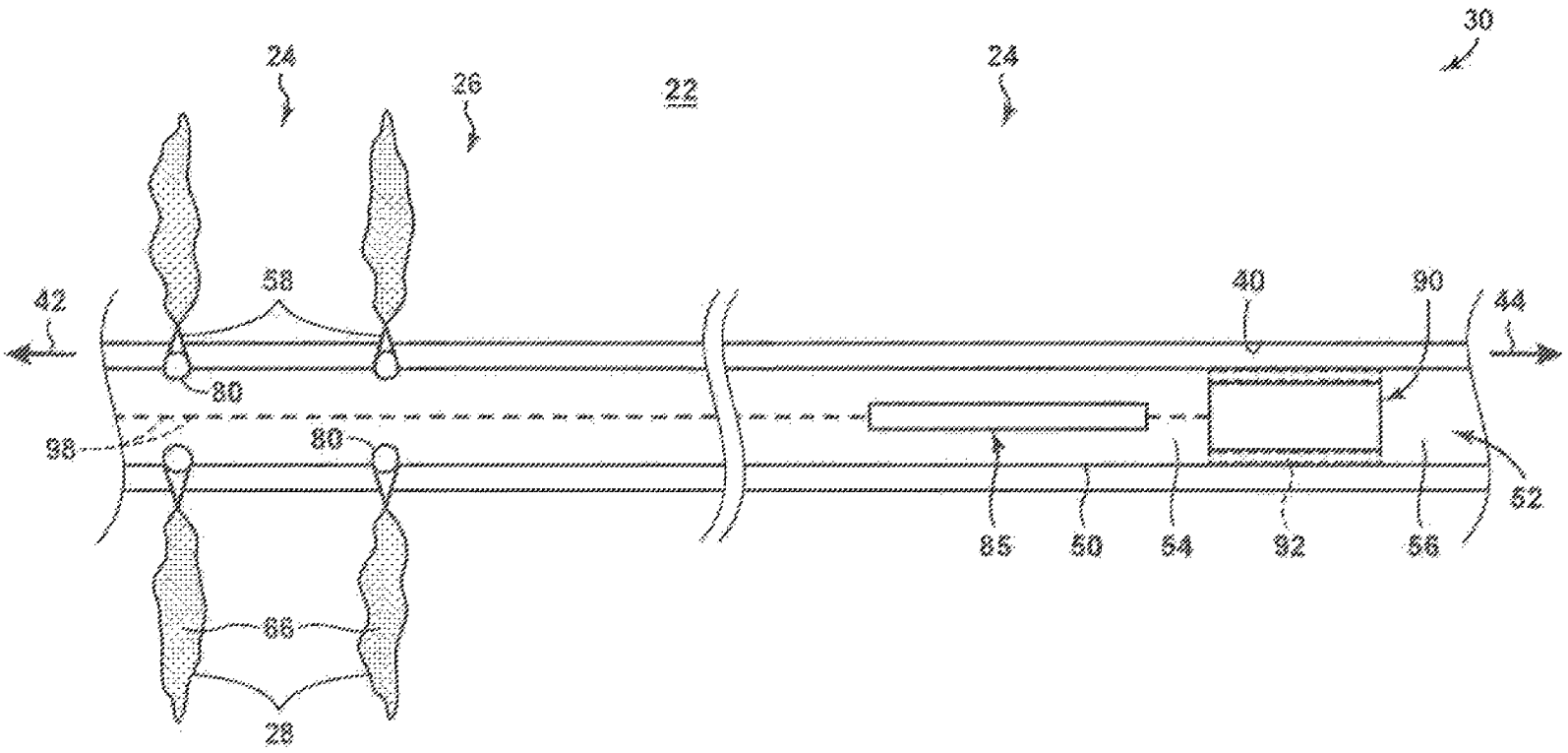
FIG. 20 is a schematic illustration of examples of another portion of the second process flow.
Figure 21:
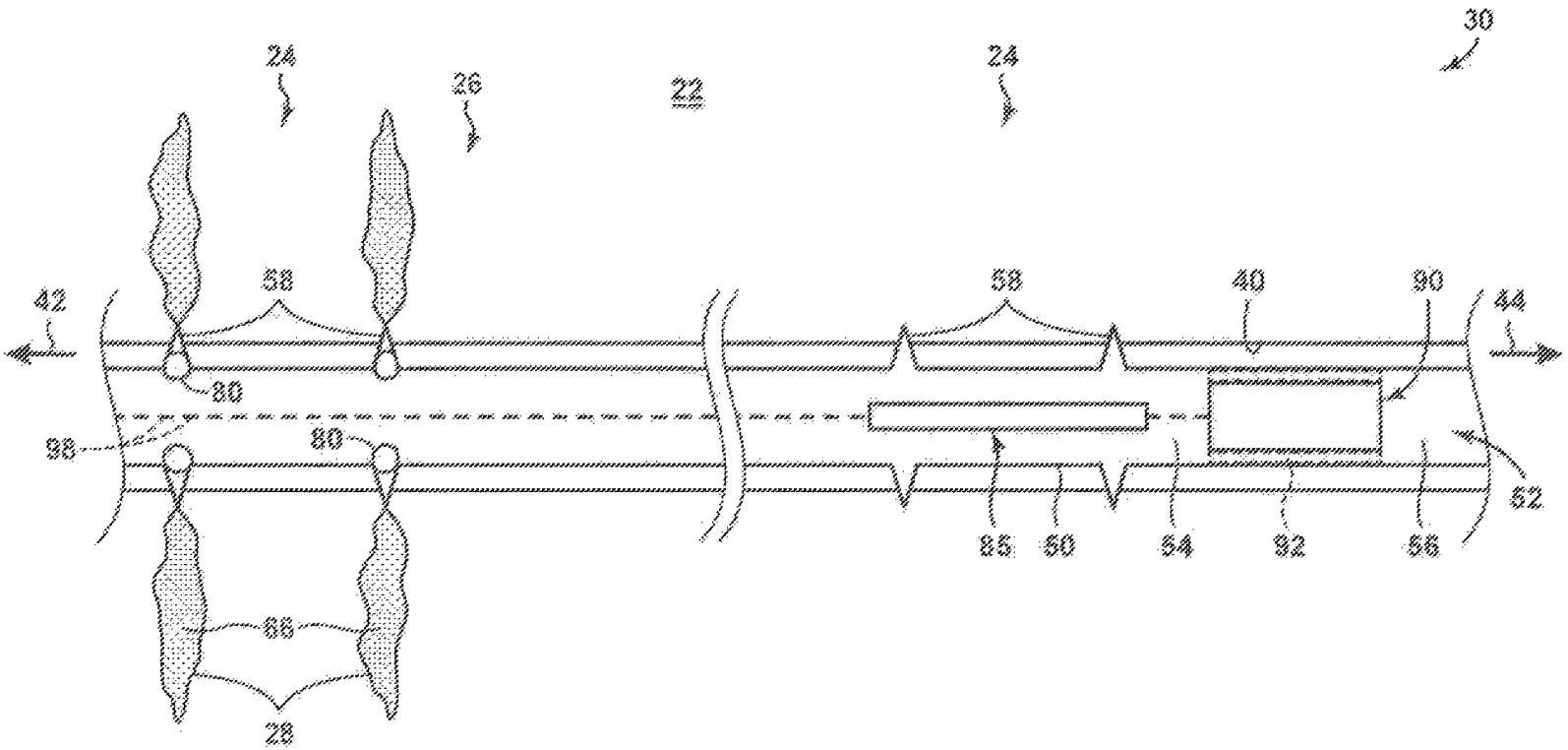
FIG. 21 is a schematic illustration of examples of another portion of the second process flow.
Figure 22:
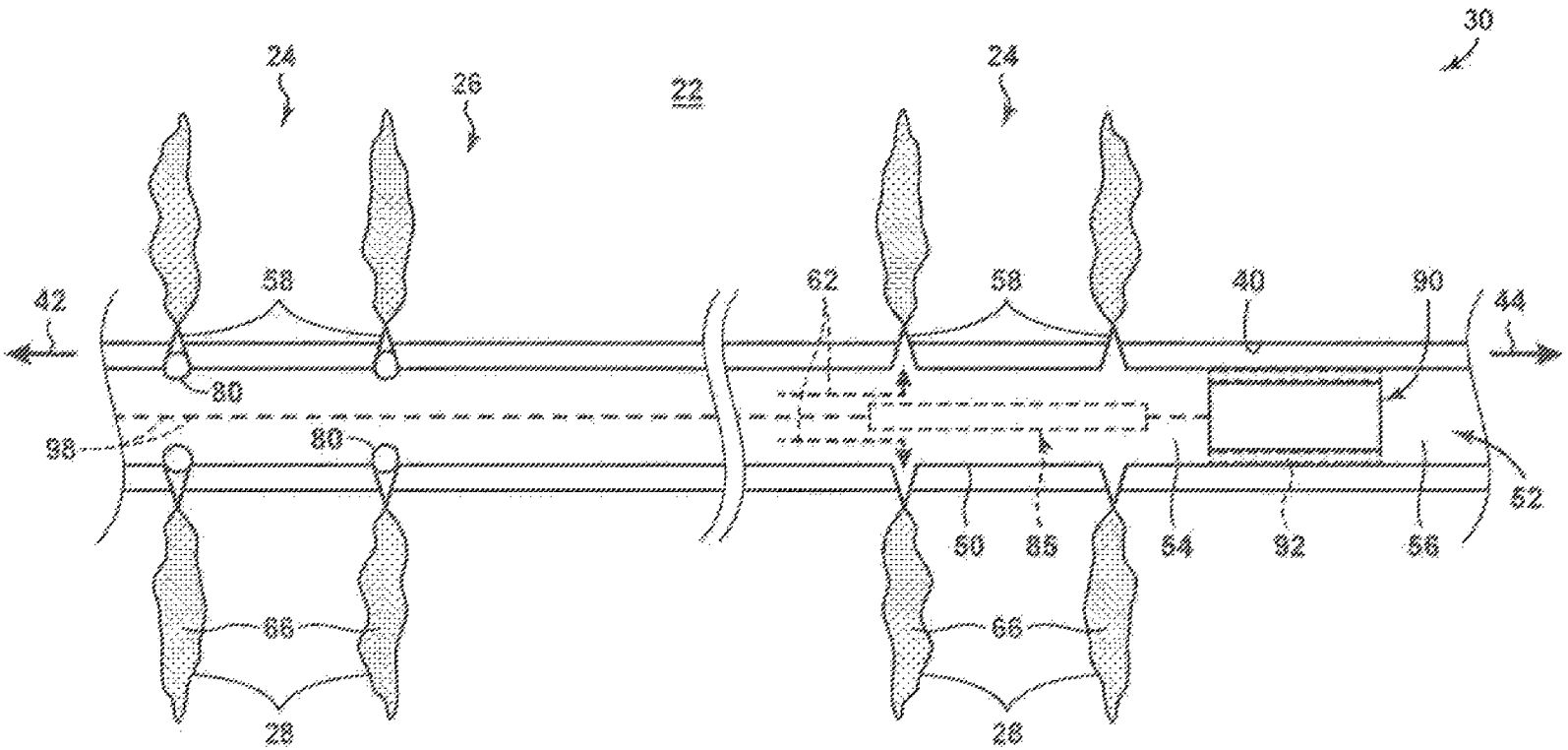
FIG. 22 is a schematic illustration of examples of another portion of the second process flow.
Figure 23:
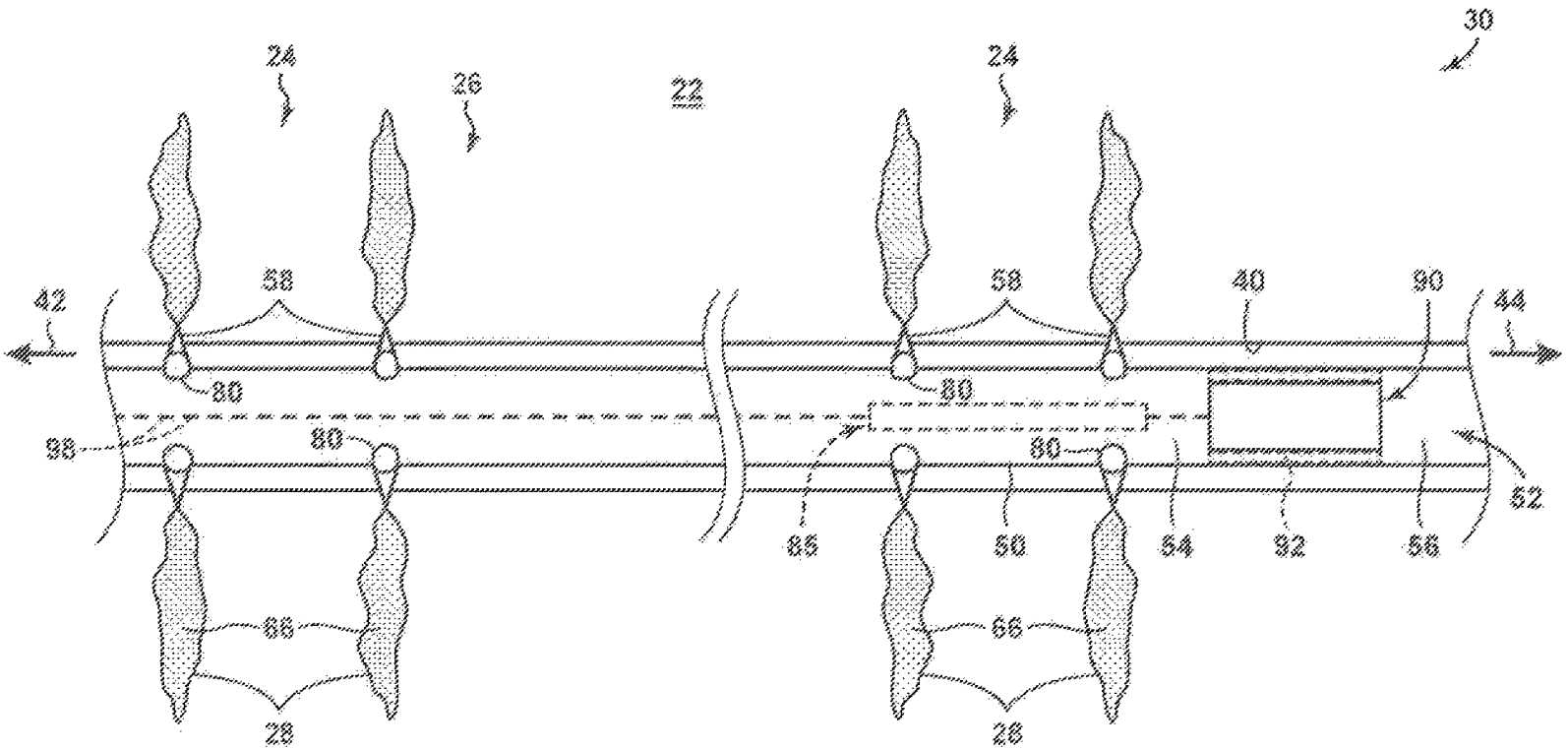
FIG. 23 is a schematic illustration of examples of another portion of the second process flow.
Figure 24:
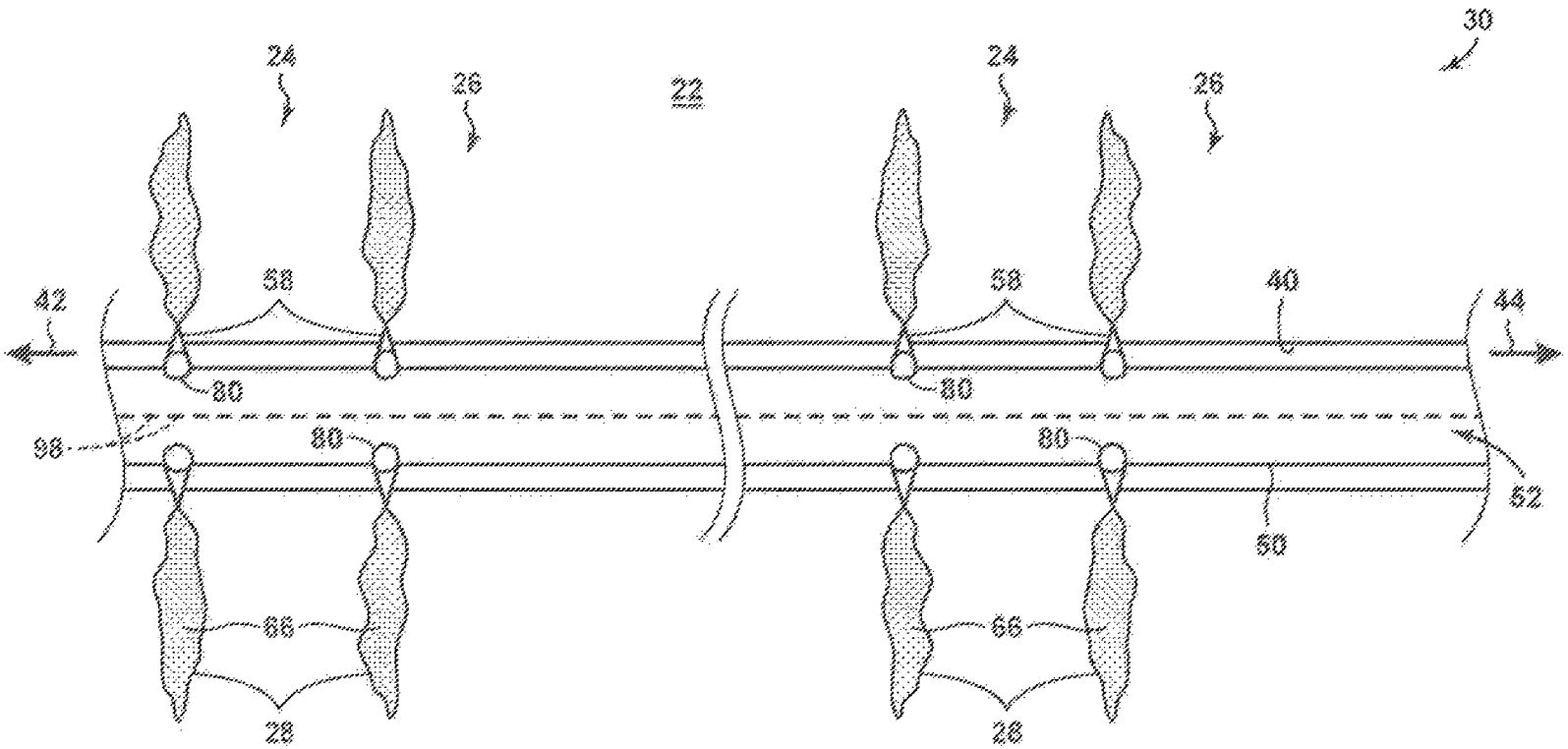
FIG. 24 is a schematic illustration of examples of another portion of the second process flow.

Referring now to the progression illustrated schematically by FIGS. 20-24, and in examples of methods 100 performed in previously unperforated tubulars 50, FIG. 20 illustrates repeating the retaining at 105 to retain sealing structure 90 within the tubular conduit and to at least partially fluidly isolate uphole region 54 from downhole region 56. FIG. 21 then illustrates repeating the perforating at 110 to form a plurality of perforations 58 within tubular 50. FIG. 22 then illustrates repeating the stimulating at 115 by providing stimulant fluid stream 62 to a corresponding zone 24 of subterranean formation 22 via perforations 58. FIG. 23 then illustrates repeating the fluidly isolating at 125 by engaging corresponding diversion structures 80 with perforations 58. FIG. 24 then illustrates repeating the moving at 140 by moving sealing structure 90 further downhole within tubular conduit 52.

The repeating at 155 may include sequentially performing at least the retaining at 105, the stimulating at 115, the fluidly isolating at 125, and the moving at 140 a plurality of times. Examples of the plurality of times include at least 2, at least 4, at least 6, at least 8, at least 10, at least 15, at most 20, at most 15, at most 10, at most 8, and/or at most 6 times. Stated another way, the repeating at 155 may include repeating at least the retaining at 105, the stimulating at 115, the fluidly isolating at 125, and the moving at 140 to sequentially stimulate at least a threshold number of zones of the subterranean formation. Examples of the threshold number of zones of the subterranean formation include at least 2, at least 4, at least 6, at least 8, at least 10, at least 15, at most 20, at most 15, at most 10, at most 8, and/or at most 6 zones of the subterranean formation. The repeating at 155 may include sequentially moving the sealing structure in the downhole direction within the tubular conduit such that each of the plurality of corresponding zones of the subterranean formation is downhole from previously stimulated zones of the plurality of corresponding zones of the subterranean formation.

Abandoning the sealing structure within the tubular conduit at 160 may include abandoning the sealing structure within the tubular conduit subsequent to the repeating at 155. This may include leaving the sealing structure within the tubular conduit and/or transitioning from the repeating at 155 to the producing at 165 while the sealing structure still is within the tubular conduit, while the sealing structure is intact within the tubular conduit, without destroying the sealing structure, and/or without removing the sealing structure from the tubular conduit. The abandoning at 160 may, for example, include abandoning the sealing structure within a toe region of the tubular conduit and/or abandoning the sealing structure in a region of the tubular conduit that is downhole from the plurality of perforations.

The abandoning at 160 may be performed with any suitable timing and/or sequence during methods 100. As examples, the abandoning at 160 may be performed subsequent to the retaining at 105, subsequent to the perforating at 110, subsequent to the stimulating at 115, subsequent to the propping at 120, subsequent to the fluidly isolating at 125, subsequent to the applying at 130, subsequent to the applying at 130, subsequent to the decreasing at 135, subsequent to the moving at 140, subsequent to the increasing at 145, subsequent to the maintaining at 150, subsequent to the repeating at 155, and/or prior to the producing at 165.

Producing the produced fluid stream at 165 may include producing the produced fluid stream from the hydrocarbon well and may be performed subsequent to the repeating at 155. The producing at 165 may include flowing a reservoir fluid from the subterranean formation into the tubular conduit via the plurality of perforations and/or flowing the reservoir fluid to the surface region via the tubular conduit. Examples of the produced fluid stream include a hydrocarbon fluid, crude oil, and/or natural gas.

The producing at 165 may be performed with any suitable timing and/or sequence during methods 100. As examples, the producing at 165 may be performed subsequent to the retaining at 105, subsequent to the perforating at 110, subsequent to the stimulating at 115, subsequent to the propping at 120, subsequent to the fluidly isolating at 125, subsequent to the applying at 130, subsequent to the decreasing at 135, subsequent to the moving at 140, subsequent to the increasing at 145, subsequent to the maintaining at 150, subsequent to the repeating at 155, and/or subsequent to the abandoning at 160.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, "at least substantially," when modifying a degree or relationship, may include not only the recited "substantial" degree or relationship, but also the full extent of the recited degree or relationship. A substantial amount of a recited degree or relationship may include at least 75% of the recited degree or relationship. For example, an object that is at least substantially formed from a material includes objects for which at least 75% of the objects are formed from the material and also includes objects that are completely formed from the material. As another example, a first length that is at least substantially as long as a second length includes first lengths that are within 75% of the second length and also includes first lengths that are as long as the second length.

INDUSTRIAL APPLICABILITY

The methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A method of stimulating a hydrocarbon well, wherein the hydrocarbon well includes a wellbore that extends within a subterranean formation and a tubular that extends within the wellbore and defines a tubular conduit, the method comprising:

retaining a sealing structure within the tubular conduit to at least partially fluidly isolate an uphole region of the tubular conduit;

during the retaining, stimulating a zone of the subterranean formation by providing a stimulant fluid stream to the uphole region and flowing the stimulant fluid stream into the zone of the subterranean formation via a plurality of perforations defined within a portion of the tubular that defines the uphole region;

subsequent to the stimulating, fluidly isolating the zone of the subterranean formation from the uphole region by at least partially sealing the plurality of perforations; and subsequent to the fluidly isolating, moving the sealing structure in a downhole direction within the tubular conduit, wherein the sealing structure is configured to initiate the moving responsive to pressure within a wellbore fluid being greater than a threshold move initiation pressure.

2. The method of claim 1, wherein the moving the sealing structure is performed at least partially in response to the threshold move initiation pressure.

3. The method of claim 1, wherein the moving the sealing structure is performed hydraulically.

4. The method of claim 1, wherein the sealing structure is an autonomous device, and wherein the moving the sealing structure is performed hydraulically.

5. The method of claim 1, wherein no additional perforations are created during the retaining, the stimulating, the fluidly isolating, and the moving a plurality of times to stimulate a plurality of corresponding zones of the subterranean formation which have previously been stimulated.

6. The method of claim 1, wherein the method further includes applying a motive force to the sealing structure to facilitate the moving.

7. The method of claim 6, wherein the moving further includes providing a motive fluid to the uphole region of the tubular conduit and flowing the sealing structure in a downhole direction and within the motive fluid.

8. The method of claim 1, wherein the retaining includes establishing an at least partial fluid seal between the sealing structure and the tubular.

9. The method of claim 8, wherein the at least partial fluid seal is sufficient to direct at least 80% of the stimulant fluid stream through the plurality of perforations during the stimulating.

10. The method of claim 1, wherein the retaining includes substantially blocking flow of the stimulant fluid stream from the uphole region to a downhole region via the tubular conduit.

11. The method of claim 1, wherein the method includes maintaining the at least partially sealing during the repeating.

12. The method of claim 1, wherein the sealing structure is a pressure-actuated sealing structure configured to perform the moving at least partially responsive to a pressure within a wellbore fluid that surrounds the sealing structure.

13. The method of claim 1, wherein the method further includes providing a motive fluid to the uphole region of the tubular conduit to provide a motive force for the moving.

14. The method of claim 1, wherein the sealing structure is configured to initiate the repeating the retaining, and wherein a threshold retaining pressure is greater than the threshold move initiation pressure.

15. The method of claim 14, wherein the method further includes increasing the pressure within the wellbore fluid to greater than the threshold retaining pressure.

16. The method of claim 15, wherein the increasing the pressure includes increasing a supply rate of a motive fluid to the uphole region of the tubular to increase the pressure within the wellbore fluid above the threshold retaining pressure.

17. The method of claim 1, wherein the plurality of perforations is defined within the portion of the tubular prior to the retaining.

18. The method of claim 1, wherein the hydrocarbon well has been previously stimulated, and wherein the hydrocarbon well includes a plurality of previously formed fractures that extend from the plurality of perforations.

19. The method of claim 1, wherein the tubular is a pre-perforated tubular that includes the plurality of perforations prior to the retaining.

* * * * *